US010464127B2

(12) United States Patent
Wagstaff et al.

(10) Patent No.: US 10,464,127 B2
(45) Date of Patent: Nov. 5, 2019

(54) NON-CONTACTING MOLTEN METAL FLOW CONTROL

(71) Applicant: NOVELIS INC., Atlanta, GA (US)

(72) Inventors: Samuel R. Wagstaff, Providence, RI (US); Wayne J. Fenton, Spokane Valley, WA (US); Robert B. Wagstaff, Greenacres, WA (US); Milan Felberbaum, Lausanne (CH); Todd F. Bischoff, Spokane Valley, WA (US); Tina J. Kosmicki, Spokane, WA (US)

(73) Assignee: NOVELIS INC., Atlanta, GA (US)

( * ) Notice: Subject to any disclaimer, the term of this patent is extended or adjusted under 35 U.S.C. 154(b) by 412 days.

(21) Appl. No.: 14/719,050

(22) Filed: May 21, 2015

(65) Prior Publication Data

US 2015/0336168 A1 Nov. 26, 2015

Related U.S. Application Data

(60) Provisional application No. 62/001,124, filed on May 21, 2014, provisional application No. 62/060,672, filed on Oct. 7, 2014.

(51) Int. Cl.
*B22D 27/02* (2006.01)
*B22D 37/00* (2006.01)
(Continued)

(52) U.S. Cl.
CPC ..... *B22D 37/00* (2013.01); *B22D 11/103* (2013.01); *B22D 11/18* (2013.01); *B22D 21/04* (2013.01);
(Continued)

(58) Field of Classification Search
CPC ..... B22D 11/103; B22D 11/18; B22D 27/02; B22D 37/00; B22D 41/507; B22D 46/00
(Continued)

(56) References Cited

U.S. PATENT DOCUMENTS 3,478,808 A 11/1969 Adams
3,669,181 A 6/1972 Schrewe
(Continued)

FOREIGN PATENT DOCUMENTS

CN 1165719 11/1997
CN 1863625 A 11/2006
(Continued)

OTHER PUBLICATIONS

International Patent Application No. PCT/US2015/032026, International Search Report and Written Opinion dated Sep. 18, 2015, 11 pages.
(Continued)

*Primary Examiner* — Kevin P Kerns
(74) *Attorney, Agent, or Firm* — Kilpatrick Townsend & Stockton LLP

(57) ABSTRACT

Systems and methods are disclosed for using magnetic fields (e.g., changing magnetic fields) to control metal flow conditions during casting (e.g., casting of an ingot, billet, or slab). The magnetic fields can be introduced using rotating permanent magnets or electromagnets. The magnetic fields can be used to induce movement of the molten metal in a desired direction, such as in a rotating pattern around the surface of the molten sump. The magnetic fields can be used to induce metal flow conditions in the molten sump to increase homogeneity in the molten sump and resultant ingot.

30 Claims, 21 Drawing Sheets

(51) Int. Cl.

| | |
|---|---|
| ***B22D 21/04*** | (2006.01) |
| ***C22C 21/00*** | (2006.01) |
| ***B22D 46/00*** | (2006.01) |
| ***B22D 11/103*** | (2006.01) |
| ***B22D 41/50*** | (2006.01) |
| ***B22D 11/18*** | (2006.01) |

(52) U.S. Cl.
CPC ..... *B22D 27/02* (2013.01); *B22D 41/507* (2013.01); *B22D 46/00* (2013.01); *C22C 21/00* (2013.01)

(58) Field of Classification Search
USPC ..... 164/500, 502, 466, 146
See application file for complete search history.

(56) References Cited

U.S. PATENT DOCUMENTS

| | | | | |
|---|---|---|---|---|
| 4,014,379 | A | 3/1977 | Getselev et al. | |
| 4,273,180 | A | 6/1981 | Tertishnikov et al. | |
| 4,495,982 | A | 1/1985 | Kaneko et al. | |
| 4,527,616 | A | 7/1985 | Kaneko et al. | |
| 4,567,936 | A * | 2/1986 | Binczewski | B22D 11/007 164/453 |
| 4,601,327 | A | 7/1986 | Kaneko et al. | |
| 4,615,376 | A | 10/1986 | Mori et al. | |
| 4,637,453 | A | 1/1987 | Ayata et al. | |
| 4,671,335 | A | 6/1987 | Ayata et al. | |
| RE32,529 | E * | 10/1987 | Vives | B22D 11/015 164/467 |
| 4,724,896 | A | 2/1988 | Rose et al. | |
| 4,828,015 | A | 5/1989 | Takeuchi et al. | |
| 4,933,005 | A * | 6/1990 | Mulcahy et al. | B22D 11/115 164/468 |
| 5,227,078 | A | 7/1993 | Augustine, III | |
| 5,244,032 | A | 9/1993 | Banksden et al. | |
| 5,307,863 | A | 5/1994 | Kubota et al. | |
| 6,021,842 | A | 2/2000 | Buelhoff et al. | |
| 6,315,029 | B1 | 11/2001 | Cho et al. | |
| 6,598,662 | B2 | 7/2003 | Kato et al. | |
| 7,201,211 | B2 | 4/2007 | Kunstreich | |
| 7,669,638 | B2 * | 3/2010 | Kollberg et al. | B22D 11/115 164/154.5 |
| 7,736,586 | B2 | 6/2010 | Takahashi | |
| 7,815,846 | B2 | 10/2010 | Takahashi | |
| 8,158,055 | B2 | 4/2012 | Takahashi | |
| 8,210,239 | B2 | 7/2012 | Toh et al. | |
| 8,336,603 | B2 | 12/2012 | Bischoff et al. | |
| 8,418,749 | B2 | 4/2013 | Toh et al. | |
| 2004/0244939 | A1 | 12/2004 | Marti et al. | |
| 2010/0025003 | A1 | 2/2010 | Wagstaff et al. | |
| 2010/0263822 | A1 * | 10/2010 | Kunstreich | B22D 11/115 164/468 |
| 2011/0097701 | A1 | 4/2011 | Hickey | |
| 2011/0248432 | A1 | 10/2011 | Takahashi | |
| 2012/0104669 | A1 | 5/2012 | Takahashi | |
| 2012/0160063 | A1 | 6/2012 | Odenthal et al. | |
| 2013/0228045 | A1 | 9/2013 | Fan et al. | |
| 2015/0336170 | A1 | 11/2015 | Wagstaff et al. | |

FOREIGN PATENT DOCUMENTS

| | | | |
|---|---|---|---|
| CN | 101166594 | A | 4/2008 |
| CN | 102437710 | | 5/2012 |
| EP | 0093068 | A1 | 11/1983 |
| EP | 0916434 | | 5/1999 |
| EP | 1059990 | A1 | 12/2000 |
| EP | 2329899 | A1 | 6/2011 |
| EP | 2045553 | B1 | 4/2012 |
| EP | 2594351 | A1 | 5/2013 |
| GB | 2079195 | A | 1/1982 |
| JP | S47034119 | A | 11/1972 |
| JP | 58196151 | | 11/1983 |
| JP | S60-234754 | A | 11/1985 |
| JP | 61108457 | | 5/1986 |
| JP | S63253854 | A | 10/1988 |
| JP | 01266950 | A | 10/1989 |
| JP | H01299747 | A | 12/1989 |
| JP | H02041747 | A | 2/1990 |
| JP | H03198974 | A | 8/1991 |
| JP | H06238413 | A | 8/1994 |
| JP | H07148561 | A | 6/1995 |
| JP | H07-290214 | A | 11/1995 |
| JP | 11123511 | | 5/1999 |
| JP | 2001501132 | A | 1/2001 |
| JP | 2010-179363 | A | 8/2010 |
| KR | 20030036247 | A | 5/2003 |
| KR | 101286192 | B1 | 7/2013 |
| KR | 1020130099331 | A | 9/2013 |
| WO | 9814292 | A1 | 4/1998 |
| WO | 9816001 | A1 | 4/1998 |
| WO | 9830346 | A1 | 7/1998 |
| WO | 2011097701 | A1 | 8/2011 |
| WO | 2011158477 | A1 | 12/2011 |
| WO | 2012008574 | A1 | 1/2012 |
| WO | 2013069314 | A1 | 5/2013 |
| WO | 2015179680 | A2 | 11/2015 |

OTHER PUBLICATIONS

International Patent Application No. PCT/US2015/032029, Invitation to Pay Additional Fees and Partial Search Report dated Sep. 23, 2015, 4 pages.

International Patent Application No. PCT/US2015/032029, International Search Report and Written Opinion dated Jan. 5, 2016, 15 pages.

International Application No. PCT/US2015/032026, International Preliminary Report on Patentability dated Dec. 1, 2016, 8 pages.

International Application No. PCT/US2015/032029, International Preliminary Report on Patentability dated Dec. 1, 2016, 10 pages.

Adachi, et al., "Application of Electromagnetic Stirrers", Continuous Casting, 1984, pp. 79-85, vol. 3, Iron and Steel Society of AIME, Warrendale, PA.

Birat, et al., "Electromagnetic Stirring on Billet, Bloom and Slab Continuous Casters State of the Art in 1982", Continuous Casting, 1984, pp. 21-34, vol. 3, Iron and Steel Society of AIME, Warrendale, PA.

Halldin, "The Electro-Magnetic Brake (EMBR) for Slab Continuous Casting Machines", Continuous Casting, 1984, pp. 111-114, vol. 3, Iron and Steel Society of AIME, Warrendale, PA.

Trindade, et al., "Numerical Model of Electromagnetic Stirring for Continuous Casting Billets", IEEE Transactions on Magnetics, Nov. 2002, pp. 3658-3660, vol. 38, No. 6, IEEE.

Tzavaras, "Solidification Control by Electromagnetic Stirring-State of the Art", Continuous Casting, 1984, pp. 47-67, vol. 3, Iron and Steel Society of AIME, Warrendale, PA.

Yamahiro, et al., "Continuous Casting of Pseudo-Rimmed Steel by In-Mold Electromagnetic Stirrer", Steelmaking Conference Proceedings, Apr. 1983, pp. 115-126, AIME, Warrendale, PA.

Zhang, et al., "Inclusions in Continuous Casting of Steel", XXIV National Steelmaking Symposium, Morelia, MI, Nov. 26-28, 2003, pp. 138-183.

Zhang, et al., "Flow Transport and Inclusion Motion in Steel Continuous-Casting Mold under Submerged Entry Nozzle Clogging Condition", Metallurgical and Materials Transactions, Aug. 2008, pp. 534-550, vol. 39B, Issue 4, Springer Science & Business Media, Warrendale, PA.

Canadian Patent Application No. 2,946,420, Office Action dated Nov. 14, 2017, 6 pages.

Davis, J. Lee, et al., "Wrinkling Phenomena to Explain Vertical Fold Defects in DC-Cast Al-Mg4.5," Essential Readings in Light Metals: vol. 3, 2016, pp. 789-804, Springer on behalf of the Minerals, Metals & Materials Society.

Korean Patent Application No. 10-2016-7034691, Office Action dated Apr. 4, 2018, 13 pages.

Moreau, Rene, et al., "MHD flow in an insulating rectangular duct under a non-uniform magnetic field", PMC Physics B, 2010, pp. 2-43, vol. 3, No. 3, Creative Commons, http://www.physmathcentral.com/1754-0429/3/3, 2010.

(56) References Cited

OTHER PUBLICATIONS

Wagstaff, Samuel R., et al., "Minimization of Macrosegregation in DC Cast Ingots Through Jet Processing," Manuscript Submitted Mar. 29, 2016, http://hdl.handle.net/1721.1/105503, Massachusetts Institute of Technology, Cambridge, MA.
Wagstaff, Samuel R., et al., "Minimization of Macrosegregation in DC Cast Ingots Through Jet Processing," Metallurgical and Materials Transactions B, Oct. 2016, pp. 3132-3138, vol. 47B, The Minerals, Metals & Materials Society and ASM International 2016.
Wagstaff, S.R., et al., "Modification of Macrosegregation Patterns in Rolling Slab Ingots by Bulk Grain Migration," Light Metals 2016, 2016, pp. 715-719, The Minerals, Metals & Materials Society.
Wagstaff, Samuel R., et al., "Shear Induced Grain Refinement of a Continuously Cast Ingot," Light Metals 2017, Feb. 12, 2017, pp. 1005-1012, Springer.
Office Action issued for Canadian Application No. 2,946,420 dated Aug. 29, 2018, 4 pages.
Office Action issued for Chinese Application No. 201580026615.4 dated Aug. 1, 2018, along with an English translation, 23 pages.
Office Action issued for Korean Application No. 10-2016-7034691 dated Aug. 1, 2018, along with an English translation, 5 pages.
Office Action issued in Japanese Application No. 2016-568501 dated Feb. 12, 2019 (5 pages) along with an English translation of Office Action Summary.
Office Action issued in Chinese Patent Application No. 201580026615.4 dated Mar. 15, 2019, along with an English translation (10 pages).

* cited by examiner

NON-CONTACTING MOLTEN METAL FLOW CONTROL

CROSS REFERENCE TO RELATED APPLICATIONS

The present application claims the benefit of U.S. Provisional Application No. 62/001,124 filed on May 21, 2014, entitled "MAGNETIC BASED STIRRING OF MOLTEN ALUMINUM," and U.S. Provisional Application No. 62/060,672 filed on Oct. 7, 2014, entitled "MAGNET-BASED OXIDE CONTROL," both of which are hereby incorporated by reference in their entirety.

TECHNICAL FIELD

The present disclosure relates to metal casting generally and more specifically to improving grain formation during aluminum casting.

BACKGROUND

In the metal casting process, molten metal is passed into a mold cavity. For some types of casting, mold cavities with false, or moving, bottoms are used. As the molten metal enters the mold cavity, generally from the top, the false bottom lowers at a rate related to the rate of flow of the molten metal. The molten metal that has solidified near the sides can be used to retain the liquid and partially liquid metal in the molten sump. Metal can be 99.9% solid (e.g., fully solid), 100% liquid, and anywhere in between. The molten sump can take on a V-shape, U-shape, or W-shape, due to the increasing thickness of the solid regions as the molten metal cools. The interface between the solid and liquid metal is sometimes referred to as the solidifying interface.

As the molten metal in the molten sump becomes between approximately 0% solid to approximately 5% solid, nucleation can occur and small crystals of the metal can form. These small (e.g., nanometer size) crystals begin to form as nuclei, which continue to grow in preferential directions to form dendrites as the molten metal cools. As the molten metal cools to the dendrite coherency point (e.g., 632° C. in 5182 aluminum used for beverage can ends), the dendrites begin to stick together. Depending on the temperature and percent solids of the molten metal, crystals can include or trap different particles (e.g., intermetallics or hydrogen bubbles), such as particles of $FeAl_6$, $Mg_2Si$, $FeAl_3$, $Al_8Mg_5$, and gross $H_2$, in certain alloys of aluminum.

Additionally, when crystals near the edge of the molten sump contract during cooling, yet-to-solidify liquid compositions or particles can be rejected or squeezed out of the crystals (e.g., out from between the dendrites of the crystals) and can accumulate in the molten sump, resulting in an uneven balance of particles or less soluble alloying elements within the ingot. These particles can move independently of the solidifying interface and have a variety of densities and buoyant responses, resulting in preferential settling within the solidifying ingot. Additionally, there can be stagnation regions within the sump.

The inhomogenous distribution of alloying elements on the length scale of a grain is known as microsegregation. In contrast, macrosegregation is the chemical inhomogeneity over a length scale larger than a grain (or number of grains), such as up to the length scale of meters.

Macrosegregation can result in poor material properties, which may be particularly undesirable for certain uses, such as aerospace frames. Unlike microsegregation, macrosegregation cannot be fixed through typical homogenization practices (i.e., prior to hot rolling). While some macrosegregation intermetallics may be broken up during rolling (e.g., $FeAl_6$, FeAlSi), some intermetallics take on shapes that are resistant to being broken up during rolling (e.g., $FeAl_3$).

While the addition of new, hot liquid metal into the metal sump creates some mixing, additional mixing can be desired. Some current mixing approaches in the public domain do not work well as they increase oxide generation.

Further, successful mixing of aluminum includes challenges not present in other metals. Contact mixing of aluminum can result in the formation of structure-weakening oxides and inclusions that result in an undesirable cast product. Non-contact mixing of aluminum can be difficult due to the thermal, magnetic, and electrical conductivity characteristics of the aluminum.

In addition to oxide formation through some mixing approaches, metal oxides can form and collect as the molten metal cascades into the mold cavity. Metal oxides, hydrogen, and/or other inclusions can collect as a froth or oxide slag on the top of the molten metal within the mold cavity. For example, during aluminum casting, some examples of metal oxides include aluminum oxide, aluminum manganese oxide, and aluminum magnesium oxide.

In direct chill casting, water or other coolant is used to cool the molten metal as it solidifies into an ingot as the false bottom of the mold cavity lowers. Metal oxides do not diffuse heat as well as the pure metal. Metal oxides that reach the side surfaces of the forming ingot (e.g., through "rollover" where the metal oxide from the upper surface of the molten metal migrates over the meniscus between the upper surface and a side surface) may contact the coolant and create a heat transfer barrier at that surface. In turn, areas with metal oxide contract at a different rate than the remainder of the metal, which can cause stress points and thus fractures or failures in the resultant ingot or other cast metal. Even small defects in a piece of cast metal can result in much larger defects when the cast metal is rolled if not adequately scalped to remove any artifact of an earlier oxide patch.

Control of metal oxide rollover can be partially achieved through the use of skimmers. Skimmers, however, do not fully control metal oxide rollover and can add moisture to the casting process. Additionally, skimmers are not typically used when casting certain alloys, such as aluminum-magnesium alloys. Skimmers can form unwanted inclusions in the metal melt. Manual oxide removal by an operator is extremely dangerous and time-consuming and risks introducing other oxides into the metal. Thus, it can be desirable to control metal oxide migration during the casting process.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
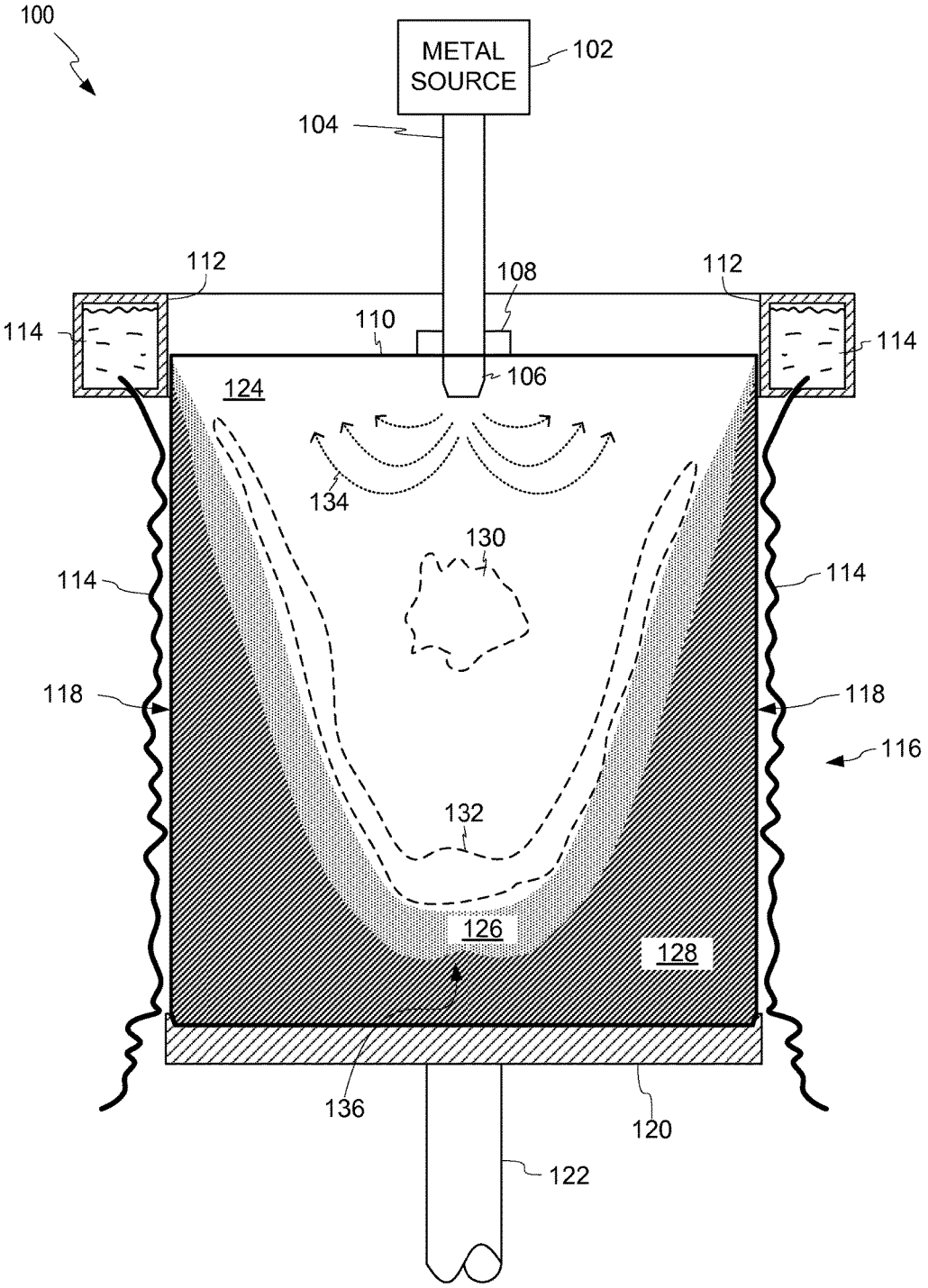
FIG. 1 is a partial cut-away view of a metal casting system with no flow inducers according to certain aspects of the present disclosure.

Certain aspects and features of the present disclosure relate to using magnetic fields (e.g., changing magnetic fields) to control metal flow conditions during aluminum casting (e.g., casting of an ingot, billet, or slab). The magnetic fields can be introduced using rotating permanent magnets or electromagnets. The magnetic fields can be used to induce movement of the molten metal in a desired direction, such as in a rotating pattern around the surface of the molten sump. The magnetic fields can be used to induce metal flow conditions in the molten sump to increase homogeneity in the molten sump and resultant ingot. Increased flow can increase the ripening of crystals in the molten sump. Ripening of solidifying crystals can include rounding the shape of the crystal such that they may be packed more closely together.

The techniques described herein can be useful for producing cast metal products. In particular, the techniques described herein can be especially useful for producing cast aluminum products.

During molten metal processing, metal flow can be achieved by non-contacting metal flow inducers. Non-contacting metal flow inducers can be magnetic based, including magnet sources such as permanent magnets, electromagnets, or any combination thereof. Permanent magnets may be desirable in some circumstances to reduce capital costs that would be necessary if electromagnets were used. For example, permanent magnets may require less cooling and may use less energy to induce the same amount of flow. Examples of suitable permanent magnets include AlNiCr, NdFeB, and SaCo magnets, although other magnets having suitably high coercivity and remanence may be used. If permanent magnets are used, the permanent magnets can be positioned to rotate about an axis to generate a changing magnetic field. Any suitable arrangement of permanent magnets can be used, such as, but not limited to, single dipole magnets, balanced dipole magnets, arrays of multiple magnets (e.g., 4-pole), Halbach arrays, and other magnets capable of generating changing magnetic fields when rotated.

The metal flow inducers can control, radially or longitudinally, the velocity of the molten metal within a metal sump, such as a metal sump of an ingot being cast. Metal flow inducers can control the velocity of molten metal against the solidifying interface, which can change the solidifying crystal-precipitate's size, shape, and/or composition. For example, using metal flow inducers to increase the metal flow across a solidifying interface can distribute rejected solute alloying elements or intermetallics that have been squeezed out at that location and can move around solidifying crystals to help ripen the crystals.

The metal flow can be induced using magnetic fields due to Lorenz forces created in conductive metals as defined by Lenz's law. The magnitude and direction of the forces induced in the molten metal can be controlled by adjusting the magnetic fields (e.g., strength, position, and rotation). When the metal flow inducers include rotating permanent magnets, control of the magnitude and direction of the forces induced in the molten metal can be achieved by controlling the rotational speed of the rotating permanent magnets.

A non-contacting metal flow inducer can include a series of rotating permanent magnets. The magnets can be integrated into a heat insulted, non-ferromagnetic shell that can be located over a molten sump. The magnetic field created by the rotating permanent magnets acts on the molten metal under an oxide layer to generate fluid flow conditions during the cast. The magnetic sources can be rotated using any suitable rotation mechanism. Examples of suitable rotation mechanisms include electric motors, fluid motors (e.g., hydraulic or pneumatic motors), adjacent magnetic fields (e.g., using an additional magnet source to induce rotation of the magnets of the magnetic source), etc. Other suitable rotation mechanisms can be used. In some cases, a fluid motor is used to rotate the motors using a coolant fluid, such as air, allowing the same fluid to both cool the magnetic source and cause rotation of the magnetic source, such as by interacting with a turbine or impeller. Permanent magnets can be rotationally free with respect to a center axle and induced to rotate around the center axle, or the permanent magnets can be rotationally fixed to a rotatable center axle.

In some non-limiting examples, the permanent magnets can be rotated at approximately 10-1000 revolutions per minute (RPM) (such as 10 RPM, 25 RPM, 50 RPM, 100 RPM, 200 RPM, 300 RPM, 400 RPM, 500 RPM, 750 RPM, 1000 RPM, or any value in between). The permanent magnets can be rotated at a speed in the range of approximately 50 RPM to approximately 500 RPM.

In some cases, the frequency, intensity, location, or any combination thereof of the changing magnetic field or fields generated above the surface of a molten sump can be adjusted based on visual inspection by an operator or camera. Visual inspection can include watching for disturbances or turbulence in the surface of the molten sump, and can include watching for the presence of crystals impacting the surface of the molten sump.

In some cases, magnetically insulating materials (e.g., magnetic shielding) can be placed between adjacent magnet sources (e.g., adjacent non-contacting molten flow inducers) to magnetically shield adjacent magnetic sources from one another.

The molten sump can be circular, symmetrical, or bilaterally non-symmetrical in shape. The shape and number of metal flow inducers used over a particular molten sump can be dictated by the shape of the molten sump and desired flow of molten metal.

In one non-limiting example, a first set of permanent magnet assemblages can rotate in series with a second set of permanent magnet assemblages. The first and second sets of assemblages can be contained in a single housing or separate housings. The first set and second set of assemblages can rotate out of phase (e.g., with unsynchronized magnetic fields) with one another, inducing linear flow in a single direction, such as along the long side of a rectangular ingot mold with reversed flow on the opposite side of the same rectangular ingot mold. Alternatively, the assemblages can rotate in phase (e.g., with synchronized magnetic fields) with one another. The assemblages can rotate at the same speed or different speeds. The assemblages can be powered by a single motor or separate motors. The assemblages can be powered by a single motor and geared to rotate at different speeds or in different directions. The assemblages can be equally or unequally spaced above the molten sump.

Magnets can be integrated into an assemblage at equally-spaced or non-equally spaced angular locations around the rotational axis. Magnets can be integrated into an assemblage at equal or differing radial distances around the rotational axis.

The rotational axis of the assemblage can be parallel to the molten metal level to be stirred (e.g., by molten flow control). The rotational axis of the assemblage can be parallel to the solidifying isotherm. The rotational axis of the assemblage can be not parallel to the generally rectangular shape of a rectangular mold cavity. Other orientations can be used.

Non-contacting molten flow inducers can be used with mold cavities of any shape, including cylindrical forming ingot molds (e.g., as used to form ingots or billets for forging or extrusion). The flow inducers can be oriented to generate curvilinear flow of the molten metal in one direction along the periphery of a cylinder forming ingot mold. The flow inducers can be oriented to generate arched flow patterns that are different from the generally circular shape of the cylinder forming ingot mold.

Non-contacting molten flow inducers can be oriented adjacent to one another about a single rotational axis (e.g., centerline of a mold cavity) and can rotate in opposing directions to generate adjacent, opposing flows from the single rotational axis. The adjacent, opposing flows can creates shear forces at the confluence of the opposing flows. Such orientations can be especially useful for large diameter ingots.

Multiple flow inducers can be oriented about non-collinear rotational axes and rotate in directions that generate opposing fluid flows that in turn create non-cylindrical shear forces at the confluence of the fluid flows.

Adjacent flow inducers can have parallel or non-parallel rotational axes.

In some cases, non-contacting molten flow inducers can be used in combination with flow directors. A flow director can be a device submergible within the molten aluminum and positioned to direct flow in a particular fashion. For example, non-contacting molten flow inducers that direct flow near the surface of the molten metal towards the edges of a cast can be paired with flow directors positioned near—but spaced apart from—the solidifying surface so that the flow directors direct flow down the solidifying surface (e.g., prohibiting metal that begins flowing down the solidifying surface to flow towards the center of the metal sump until after it has flowed down a substantial portion of the solidifying surface).

In some cases, non-contact induced circular flow can distribute macrosegregated intermetallics and/or partially-solidified crystals (e.g., iron) very evenly throughout the molten sump. In some cases, non-contact induced linear flow towards or away from the long faces of the cast can distribute macrosegregated intermetallics (e.g., iron) along the center of the cast product. Macrosegregated intermetallics directed to form along the center of the cast product can be beneficial in some circumstances, such as in aluminum sheet products that need to be bent.

In some cases, it can be desirable to induce the formation of intermetallics of a particular size (e.g., large enough to induce recrystallization during hot rolling, but not large enough to cause failures). For example, in some cast aluminum, intermetallics having a size of less than 1 μm in equivalent diameter are not substantially beneficial; intermetallics having a size of greater than about 60 μm in equivalent diameter can be harmful and large enough to potentially cause failures in final gauge of a rolled sheet product after cold rolling. Thus, intermetallics having a size (in equivalent diameter) of about 1-60 μm, 5-60 μm, 10-60 μm, 20-60 μm, 30-60 μm, 40-60 μm, or 50-60 μm can be desirable. Non-contact induced molten metal flow can help distribute intermetallics around sufficiently so that these semi-large intermetallics are able to form more easily.

In some cases, it can be desirable to induce the formation of intermetallics that are easier to break apart during hot rolling. Intermetallics that can be easily broken up during rolling tend to occur more often with increased mixing or stirring, especially into the stagnation regions, such as the corners and center and/or bottom of the sump.

Increased mixing or stirring can be used to increase homogeneity within the molten sump and resultant ingot, such as by mixing crystals and heavy particles. Increased mixing or stirring can also move crystals and heavier particles around the molten sump, slowing the solidification rate and allowing alloying elements to diffuse throughout the solidifying metal crystals. Additionally, the increased mixing or stirring can allow forming crystals to ripen faster and to ripen for longer (e.g., due to slowed solidification rate).

The techniques described herein also can be used to induce sympathetic flow throughout a molten metal sump. Due to the shape of the molten metal sump and the properties of the molten metal, primary flow (e.g., flow induced directly on the metal from the flow inducer) cannot reach the entire depth of the molten sump. Sympathetic flow (e.g., secondary flow induced by the primary flow), however, can be induced through proper placement and strength of primary flow, and can reach the stagnation regions within the molten sump, such as those described above.

Ingots cast with the techniques described herein may have a uniform grain size, unique grain size, intermetallic distribution along the exterior surface of the ingot, non-typical macrosegregation effect in the center of the ingot, increased homogeneity, or any combination thereof. Ingots cast using the techniques and systems described herein may have additional beneficial properties. A more uniform grain size and increased homogeneity can reduce or eliminate the need for grain refiners to be added to the molten metal. The techniques described herein can create increased mixing without cavitation and without increased oxide generation. Increased mixing can result in a thinner liquid-solid interface within the solidifying ingot. In an example, during the casting of an aluminum ingot, if the liquid-solid interface is approximately 4 millimeters in width, it may be reduced by up to 75% or more (to approximately 1 millimeter in width or less) when non-contacting molten flow inducers are used to stir the molten metal.

In some cases, the use of the techniques disclosed herein can decrease the average grain sizes in a resultant cast product and can induce relatively even grain size throughout the cast product. For example, an aluminum ingot cast using the techniques disclosed herein can have only grain sizes at or below approximately 280 μm, 300 μm, 320 μm, 340 μm, 360 μm, 380 μm, 400 μm, 420 μm, 440 μm, 460 μm, 480 μm, or 500 μm, 550 μm, 600 μm, 650 μm, or 700 μm. For example, an aluminum ingot cast using the techniques disclosed herein can have an average grain size at or below approximately 280 μm, 300 μm, 320 μm, 340 μm, 360 μm, 380 μm, 400 μm, 420 μm, 440 μm, 460 μm, 480 μm, 500 μm, 550 μm, 600 μm, 650 μm, or 700 μm. Relatively even grain size can include maximum standard deviations in grain size at or under 200, 175, 150, 125, 100, 90, 80, 70, 60, 50, 40, 30, 20 or smaller. For example, a product cast using the techniques disclosed herein can have a maximum standard deviation in grain size at or under 45.

In some cases, the use of the techniques disclosed herein can decrease the dendrite arm spacing (e.g., distance between adjacent dendrite branches of dendrites in crystalized metal) in the resultant cast product and can induce relatively even dendrite arm spacing throughout the cast product. For example, an aluminum ingot cast using the non-contacting molten flow inducers can have average dendrite arm spacing across the entire ingot of about 10 μm, 15 μm, 20 μm, 25 μm, 30 μm, 35 μm, 40 μm, 45 μm, or 50 μm. Relatively even dendrite arm spacing can include a maximum standard deviation of dendrite arm spacing at or under 16, 15, 14, 13, 12, 11, 10, 9, 8.5, 8, 7.5, 7, 6.5, 6, 5.5, 5 or smaller. For example, a cast product having average dendrite arm spacing (e.g., as measured at locations across the thickness of a cast ingot at a common cross section) of 28 μm, 39 μm, 29 μm, 20 μm, and 19 μm can have a maximum standard deviation of dendrite arm spacing of approximately 7.2. For example, a product cast using the techniques disclosed herein can have a maximum standard deviation of dendrite arm spacing at or under 7.5.

In some cases, the techniques described herein can allow for more precise control of macrosegregation (e.g., intermetallics or where the intermetallics collect). Increased control of intermetallics can allow for optimal grain structures to be produced in a cast product despite starting with molten material having higher content of alloying elements or higher recycled content, which would normally hinder the formation of optimal grain structures. For example, recycled aluminum can generally have a higher iron content than new or prime aluminum. The more recycled aluminum used in a cast, generally the higher the iron content, unless additional time-consuming and cost-intensive processing is done to dilute the iron content. With a higher iron content, it can sometimes be difficult to produce a desirable product (e.g., with small crystal sizes throughout and without undesirable intermetallic structures). However, increased control of intermetallics, such as using the techniques described herein, can enable the casting of desirable products, even with molten metal having high iron content, such as 100% recycled aluminum. The use of 100% recycled metals can be strongly desirable for environmental and other business needs.

In some cases, the non-contact flow inducers can include magnetic sources having elements to shield the magnets from radiative and conductive heat transfer, such as a radiant heat reflector and/or a low thermally conductive material. The magnetic sources can include a lining with low thermal conductivity (e.g., a refractory lining or an aerogel), such as to inhibit conductive heat transfer. The magnetic sources can include a metal shell, such as a polished metal shell (e.g., to reflect radiative heat). The magnetic sources can additionally include a cooling mechanism. If desired, a heat sink can be associated with the magnetic source to dissipate heat. In some cases, a coolant fluid (e.g., water or air) can be forced around or through the magnetic source to cool the magnetic source. In some cases, shielding and/or cooling mechanisms can be used to keep the temperature of the magnets down so that the magnets do not become demagnetized. In some cases, the magnets can incorporate shielding and/or porous metals such as MuMetals to shield and/or redirect magnetic fields away from equipment and/or sensor that may be negatively affected by the magnetic fields generated by the magnets.

Permanent magnets placed adjacent one another along a center axle can be oriented to have offset poles. For example, the north poles of sequential magnets can be approximately 60° offset from the adjacent magnets. Other offset angles can be used. The staggered poles can limit resonation in the molten metal due to magnetic movement of the molten metal. Alternatively, the poles of adjacent magnets are not offset. In cases where non-permanent magnets are used, generated magnetic fields can be staggered to achieve a similar effect.

As the one or more magnetic sources create changing magnetic fields, it can induce fluid flow in any molten metal below the magnetic sources in a direction generally normal to the center axes of the magnetic sources (e.g., axes of rotation for a rotating permanent magnet magnetic source). The center axis (e.g., axis of rotation) of a magnetic source can be generally parallel with the surface of the molten metal.

The disclosed concepts can be used in monolithic casting or multi-layer castings (e.g., simultaneous casting of clad ingots), where rotating magnets can be used to control fluid flow of molten metal away from or towards the interface between the different types of molten metal. The disclosed concepts can be used with molds of any shape, including, but not limited to, rectangular, circular, and complex shapes (e.g., shaped ingots for extrusion or forging).

In some cases, the one or more magnetic sources can be coupled to a height adjustment mechanism that can be used to raise and lower the one or more magnetic sources with respect to the mold. During the casting process, it may be desirable to maintain uniform distance between the one or more magnetic sources and the upper surface of the molten metal. The height adjustment mechanism can adjust the height of the one or more magnetic sources if the upper surface of the molten metal raises or lowers. The height adjustment mechanism can be any mechanism suitable for adjusting the distance between the one or more magnetic sources and the upper surface (e.g., if that difference changes). The height adjustment mechanism may include sensors capable of detecting changes in the height of the upper surface. The height adjustment mechanism may detect metal levels, such as changes in metal levels referenced from a set point of the upper surface. The one or more magnetic sources can be suspended by wires, chains or other suitable devices. The one or more magnetic sources can be coupled to a trough above the mold and/or coupled to the mold itself.

In some cases, the use of one or more magnetic sources as disclosed herein can aid in normalizing the temperature of the molten metal, such as during the initial phase where non-normalized temperatures can make starting the cast more difficult.

In some cases, the use of one or more magnetic sources as disclosed herein can aid in distributing molten metal to any corners between the walls of the mold. Such distribution can help eliminate the meniscus effect (e.g., a small 0.5 to 6 millimeter gap) at those corners. Such distribution can be accomplished during the initial phase by generating fluid flow of molten metal towards the walls of the mold.

In some cases, one or more magnetic sources can be positioned within or around the walls of the mold or in any other suitable location relative to the molten metal. In one non-limiting example, the one or more magnetic sources are positioned adjacent the meniscus. In another non-limiting example, the one or more magnetic sources are positioned approximately above the center of the upper surface of the molten metal.

Various non-contacting flow inducers can be used at varying times. Adjusting the timing of the generation of changing magnetic fields can provide desired results at different points in time during the casting process. For example, no field could be generated at the beginning of the casting process, a strong changing magnetic field could be generated in a first direction during a first portion of the casting process, and a weak changing magnetic field could be generated in an opposite direction during a second portion of the casting process. Other variations in timing can be used.

Additionally, the use of one or more magnetic sources at the meniscus can modify the grain structures. Grain structures can thus be modified through forced convection. Grain structures can be modified by exciting the velocity of the molten metal at the solid/liquid interface (e.g., by forcing hot metal from the upper surface down the solidifying interface). Such effect can be enhanced through the use of flow directors, as described herein.

Certain other aspects and features of the present disclosure relate to using an alternating magnetic field to control the migration of molten metal oxide on the surface of molten metal, such as during casting (e.g., casting of an ingot, billet, or slab). The alternating magnetic field can be introduced using rotating permanent magnets or electromagnets, as described herein. The alternating magnetic field can be used to push or otherwise induce movement of metal oxide in a desired direction, such as towards a meniscus at the start of casting, towards the center during steady-state casting, and towards the meniscus at the end of casting, thus minimizing rollover of metal oxide in the middle portion of the cast metal ingot and instead concentrating any oxide formation at the ends of the cast metal. The alternating magnetic field can further be used to deform the meniscus and to steer metal oxide during non-casting processes, such as during filtering and degassing of molten metal. Eddy currents produced in the upper surface of the molten metal can additionally inhibit the meniscus effect by helping molten metal reach any corners where the walls of the mold meet.

During molten metal processing, movement, and casting, layers of metal oxide can form on the surface of the molten metal. Metal oxide is generally undesirable, as it can clog filters and generate defects in a cast product. Use of a non-contacting magnetic source to control migration of metal oxide allows for increased control of the buildup and movement of metal oxide. Metal oxide can be directed towards desired locations (e.g., away from a filter which the metal oxide might clog and towards a metal oxide removing path having a different filter and/or a location for an operator to safely remove the metal oxides). Non-contacting magnetic sources can be used to generate alternating magnetic fields that cause eddy currents (e.g., metal flow) to form on or near the upper surface of the molten metal, which can be used to steer the metal oxide supported by the upper surface of the molten metal in a desired direction. Examples of suitable magnetic sources include those described herein with reference to flow control devices.

The magnetic sources can be rotated using any suitable rotation mechanism. In some cases, the permanent magnets can be rotated at about 60-3000 revolutions per minute.

Permanent magnets placed adjacent one another along a center axle can be oriented to have offset poles, as described herein. The staggered poles can limit resonation in the molten metal due to magnetic movement of the molten metal. Oxide generation due to movement of the molten metal can be likewise limited through the use of staggered poles.

As the one or more magnetic sources create alternating magnetic fields, they can induce eddy currents (e.g., metal flow) in any molten metal below the magnetic sources in a direction generally normal to the center axes of the magnetic sources (e.g., axes of rotation for a rotating permanent magnet magnetic source). The center axes (e.g., axes of rotation) of a magnetic source can be generally parallel with the surface of the molten metal.

In the casting process, molten metal can be introduced into a mold by a dispenser. A skimmer can be optionally used to trap some metal oxide in a region immediately surrounding the dispenser. One or more magnetic sources can be positioned between the dispenser and the walls of the mold to generate eddy currents in the surface of the molten metal sufficient to control and/or induce migration of metal oxide along the surface of the molten metal. Each magnetic source can generate an alternating magnetic field (e.g., from rotation of permanent magnets) that induces eddy currents in directions normal to the wall of the mold opposite the magnetic source from the dispenser (e.g., along a line from the dispenser to the wall). The use of multiple magnetic sources can allow metal oxide migration to be controlled in multiple fashions and directions, including collecting the metal oxide in the center of the upper surface (e.g. near the dispenser) and thus inhibiting it form approaching the meniscus of the upper surface (e.g., adjacent where the upper surface meets the walls of the mold). Metal oxide migration can also be controlled to push metal oxide away from the dispenser and towards the meniscus of the upper surface.

In some cases, a casting process can include an initial phase, a steady-state phase, and a final phase. During the initial phase, molten metal is first introduced into the mold and the first several inches (e.g., five to ten inches) of the cast metal are formed. This portion of the cast metal is sometimes referred to as the bottom or butt of the cast metal, which may be removed and scrapped. After the initial phase, the casting process reaches a steady-state phase where the middle portion of the cast metal is formed. As used herein, the term "steady-state phase" can refer to any running phase of the casting process where the middle portion of the cast metal is formed, regardless of any acceleration or lack of acceleration in the casting speed. After the steady-state phase, the final phase occurs where the top of the cast metal is formed and the casting process completes. Like the butt of the cast metal, the top of the cast (or head of the ingot) metal may be removed and scrapped.

In some cases, metal oxide migration can be controlled so that metal oxide is directed towards the meniscus of the upper surface during the initial phase and optionally during the final phase. During the steady-state phase, however, the metal oxide can be directed away from the meniscus of the upper surface. As a result, any metal oxides formed in the cast metal will be concentrated at the bottom and/or top of the cast metal, both of which may be removed and scrapped, resulting in a middle portion of the cast metal ingot having minimal metal oxide buildup. Metal oxide can be directed towards the meniscus during the initial phase to leave more room on the upper surface during the steady-state phase. Metal oxide can be directed towards the meniscus during the final phase to spread out the metal oxide that had been collected on the upper surface (e.g., so that the metal oxide will be incorporated in as short of a segment of the cast metal as possible).

In some cases, the alternating magnetic field is started within approximately one minute of the molten metal entering the mold. The alternating magnetic field can continue during the initial phase until the zenith of metal level is approached, at which point the alternating magnetic field can reverse directions to direct metal oxide away from the meniscus and toward the center of the upper surface of the molten metal.

The disclosed concepts can be used in monolithic casting or multi-layer castings (e.g., simultaneous casting of clad ingots), where rotating magnets can be used to direct oxide away from the interface between the different types of molten metal. The disclosed concepts can be used with molds of any shape, including rectangular, circular, and complex shapes (e.g., shaped ingots for extrusion or forging).

In some cases, the one or more magnetic sources can be positioned above the upper surface of the molten metal and only between the dispenser and walls of the mold which form the rolling sides of the cast metal (e.g., those sides which are contacted by work rolls during rolling). In other cases, one or more magnetic sources are positioned above the upper surface of the molten metal and between the dispenser and all walls of the mold.

In some cases, one or more magnetic sources can be positioned within or around the walls of the mold or in any other suitable location relative to the molten metal. In some cases, the one or more magnetic sources are positioned adjacent the meniscus. In other cases, the one or more magnetic sources are positioned approximately above the center of the upper surface of the molten metal.

In some cases, the one or more magnetic sources can generate alternating magnetic fields adjacent the meniscus to deform the meniscus, such as by increasing or decreasing the height of the meniscus with respect to the height of the remainder of the upper surface of the molten metal. Increasing the height of the meniscus can aid in preventing metal oxide rollover by acting as a physical barrier to rollover and can be useful during the steady-state phase. Decreasing the height of the meniscus can aid in allowing metal oxide to roll over easier, which can be used during the initial phase and/or final phase.

In some cases, non-contacting magnetic sources can simultaneously and/or selectively act as flow inducers and metal oxide controllers, as described herein. In some cases, a flow inducer can be positioned closer to the molten metal to induce deeper metal flow, while a metal oxide controller is positioned at a greater distance from the molten metal to induce a shallower metal flow (e.g., eddy currents).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a partial cut-away view of a metal casting system 100 with no flow inducers according to certain aspects of the present disclosure. A metal source 102, such as a tundish, can supply molten metal down a feed tube 104. A skimmer 108 can be used around the feedtube 104 to help distribute the molten metal and reduce generation of metal oxides at the upper surface of the molten sump 110. A bottom block 120 may be lifted by a hydraulic cylinder 122 to meet the walls of the mold cavity 112. As molten metal begins to solidify within the mold, the bottom block 120 can be steadily lowered. The cast metal 116 can include sides 118 that have solidified, while molten metal added to the cast can be used to continuously lengthen the cast metal 116. In some cases, the walls of the mold cavity 112 define a hollow space and may contain a coolant 114, such as water. The coolant 114 can exit as jets from the hollow space and flow down the sides 118 of the cast metal 116 to help solidify the cast metal 116. The ingot being cast can include a solidified metal region 128, a transitional metal region 126, and a molten metal region 124.

When no flow inducers are used, the molten metal exiting the dispenser 106 flows in a pattern generally indicated by flow lines 134. The molten metal may only flow approximately 20 millimeters below the dispenser 106 before returning to the surface. The flow lines 134 of the molten metal generally stay near the surface of the molten sump 110, not reaching the middle and lower portions of the molten metal region 124. Therefore, the molten metal in the middle and lower portions of the molten metal region 124, especially the areas of the molten metal region 124 adjacent the transitional metal region 126, are not well-mixed.

As described above, due to the preferential settling of the crystals formed during solidification of the molten metal, a stagnation region 130 of crystals can occur in the middle portion of the molten metal region 124. The accumulation of these crystals in the stagnation region 130 can cause problems in ingot formation. The stagnation region 130 can achieve solid fractions of up to approximately 15% to approximately 20%, although other values outside of that range are possible. Without the use of flow inducers, the molten metal does not flow well (e.g., see flow lines 134)

into the stagnation region 130 well, and thus the crystals that may form in the stagnation region 130 accumulate and are not mixed throughout the molten metal region 124.

Additionally, as alloying elements are rejected from the crystals forming in the solidifying interface, they can accumulate in a low-lying stagnation region 132. Without the use of flow inducers, the molten metal does not flow well (e.g., see flow lines 134) into the low-lying stagnation region 132, and thus the crystals and heavier particles within the low-lying stagnation region would not normally mix well throughout the molten metal region 124.

Additionally, crystals from an upper stagnation region 130 and the low-lying stagnation region 132 can fall towards and collect near the bottom of the sump, forming a center hump 136 of solid metal at the bottom of the transitional metal region 126. This center hump 136 can result in undesirable properties in the cast metal (e.g., an undesirable concentration of alloying elements, intermetallics and/or an undesirably large grain structure). Without the use of flow inducers, the molten metal does not flow (e.g., see flow lines 134) low enough to move around and mix up these crystals and particles that have accumulated near the bottom of the sump.

Figure 2:
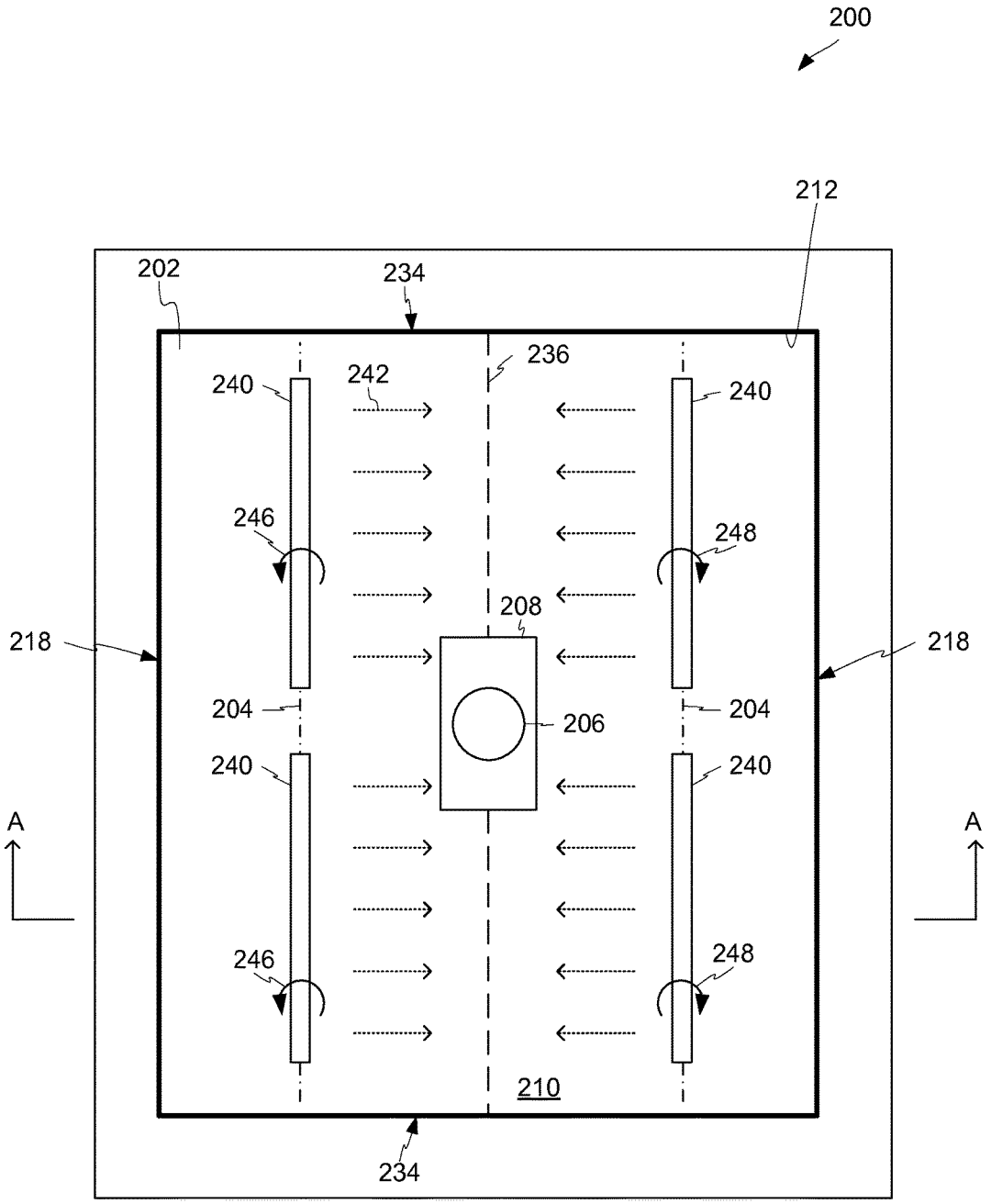
FIG. 2 is a top view of a metal casting system using flow inducers in a lateral orientation according to certain aspects of the present disclosure.

FIG. 2 is a top view of a metal casting system 200 using flow inducers 240 in a lateral orientation according to certain aspects of the present disclosure. The flow inducers 240 are non-contacting molten flow inducers using rotating permanent magnets. Other non-contacting molten flow inducers can be used, such as electromagnetic flow inducers.

The mold cavity 212 is configured to contain molten metal 210 within a set of long walls 218 and short walls 234. While the mold cavity 212 is shown as being rectangular in shape, any other shaped mold cavity can be used. Molten metal 210 is introduced to the mold cavity 212 through dispenser 206. An optional skimmer 208 can be used to collect some metal oxide that may form as the molten metal exits the dispenser 206 into the mold cavity 212.

Each flow inducer 240 can include one or more magnetic sources. The flow inducers 240 can be positioned adjacent to and above the surface 202 of the molten metal 210. Although four flow inducers 240 are illustrated, any suitable number of flow inducers 240 may be used. As described above, each flow inducer 240 may be positioned above the surface 202 in any suitable way, including by suspension. Magnetic sources in the flow inducers 240 can include one or more permanent magnets rotatable about rotational axes 204 to generate a changing magnetic field. Electromagnets may be used instead of or in addition to permanent magnets to generate the changing magnetic field.

The flow inducers 240 can be positioned on opposite sides of a mold centerline 236 with their rotational axes 204 parallel the mold centerline 236. The flow inducers 240 located on one side of the mold centerline 236 (e.g., the left side as seen in FIG. 2) can rotate in a first direction 246 to induce metal flow 242 towards the mold centerline 236. The flow inducers 240 located on the opposite side of the mold centerline 236 (e.g., the right side as seen in FIG. 2) can rotate in a second direction 248 to induce metal flow 242 towards the mold centerline 236. The interaction between metal flows 242 on opposite sides of the mold centerline 236 can generate increased mixing within the molten metal 210, as described herein.

The flow inducers 240 can be rotated in other directions to induce metal flow 242 in other directions. The flow inducers 240 can be located in different orientations other than having rotational axes 204 parallel to the mold centerline 236 or parallel to each other.

Figure 3:
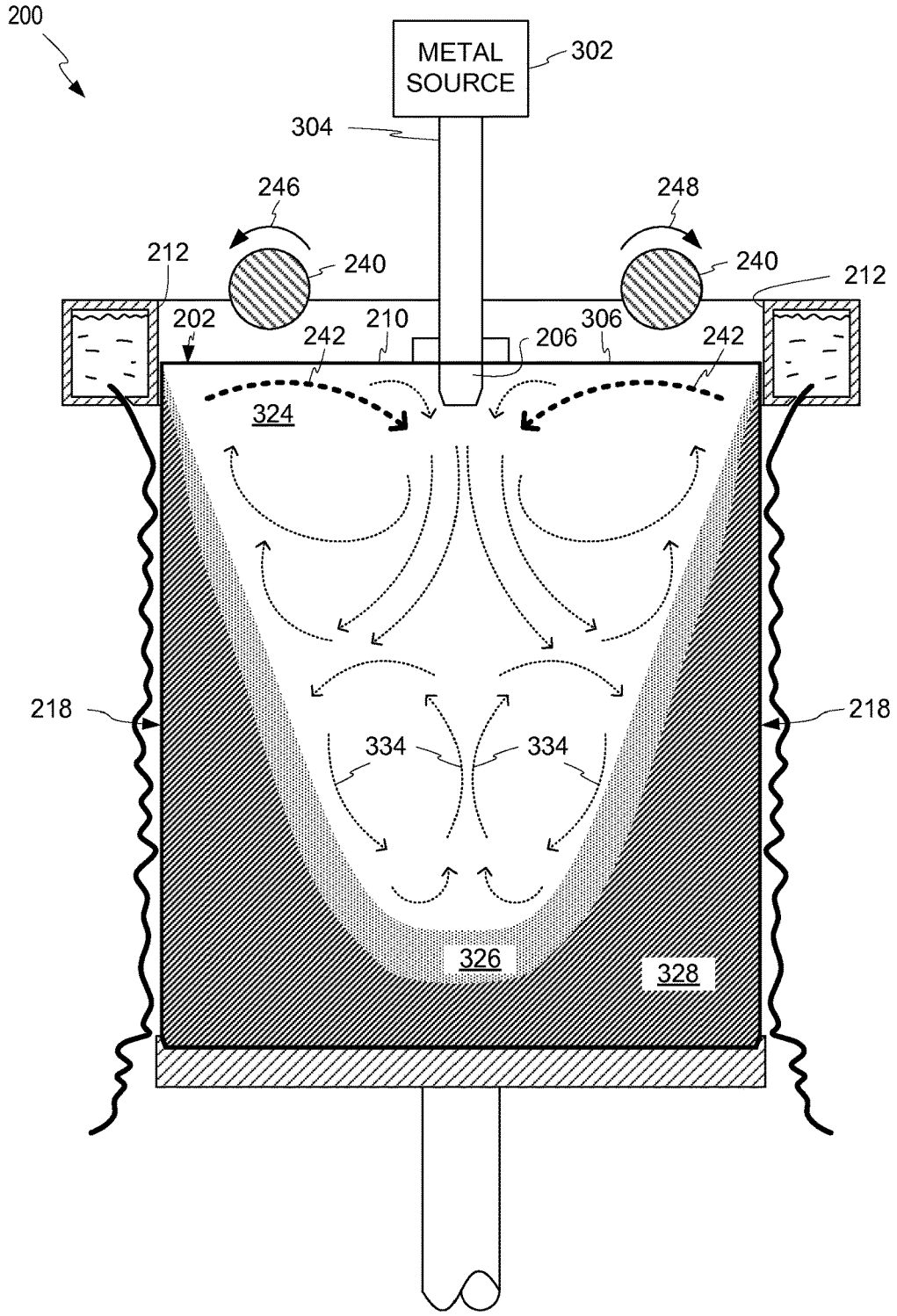
FIG. 3 is a cross-sectional diagram of the metal casting system of FIG. 2 taken across lines A-A according to certain aspects of the present disclosure.

FIG. 3 is a cross-sectional diagram of the metal casting system 200 of FIG. 2 taken across lines A-A according to certain aspects of the present disclosure. Molten metal flows from the metal source 302, down the feed tube 304, and out the dispenser 206. The metal in the mold cavity 212 can include a solidified metal region 328, a transitional metal region 326, and a molten metal region 324.

Two flow inducers 240 are seen above the surface 202 of the molten sump 306. One flow inducer 240 rotates in a first direction 246 while the other rotates in a second direction 248. The rotation of the flow inducers 240 induces molten flow 242 in the molten metal 210 of the molten sump 306. The molten flow 242 induced by the flow inducers 240 induces sympathetic flow 334 throughout the molten sump 306. The sympathetic flow 334 throughout the molten sump 306 can provide increased mixing and can preclude the formation of stagnation regions. Additionally, due to increased thermal homogeneity, the transitional metal region 326 can be smaller or thinner than when no flow inducers 240 are used. The flow inducers 240 can stir the molten metal 210 sufficiently to decrease the width of the transitional metal region 326 by up to 75% or more. For example, if the width of the transitional metal region 326 would ordinarily be approximately 4 millimeters or any other suitable width, the use of flow inducers as described herein can reduce that width to less than approximately 4 millimeters, such as but not limited to less than 3 millimeters or less than 1 millimeter or smaller.

Figure 4:
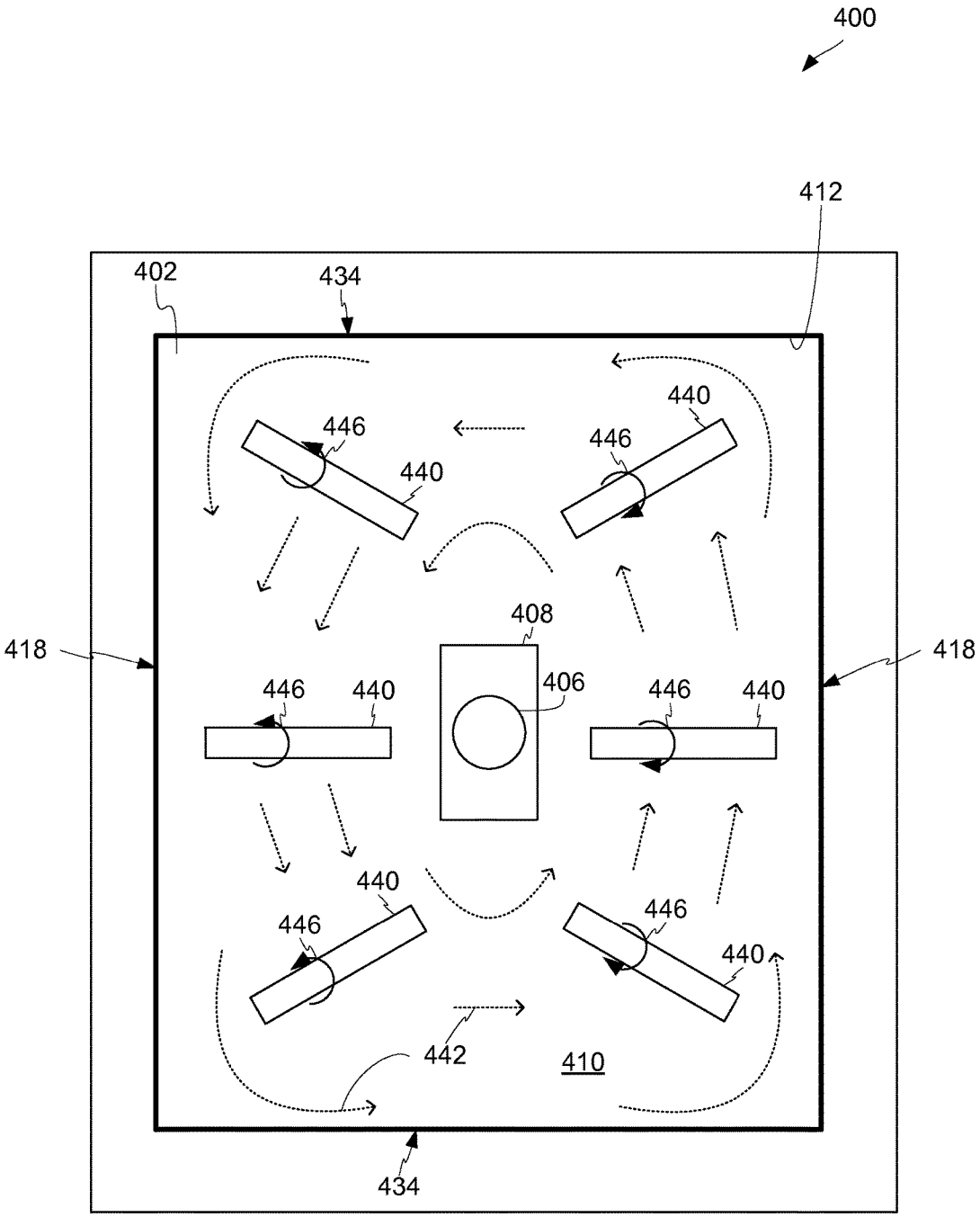
FIG. 4 is a top view of a metal casting system using flow inducers in a radial orientation according to certain aspects of the present disclosure.

FIG. 4 is a top view of a metal casting system 400 using flow inducers 440 in a radial orientation according to certain aspects of the present disclosure. The flow inducers 440 are non-contacting molten flow inducers using rotating permanent magnets. Other non-contacting molten flow inducers can be used, such as electromagnetic flow inducers.

The mold cavity 412 is configured to contain molten metal 410 within a set of long walls 418 and short walls 434. While the mold cavity 412 is shown as being rectangular in shape, any other shaped mold cavity can be used. Molten metal 410 is introduced to the mold cavity 412 through feed tube 406. An optional skimmer 408 can be used to collect some metal oxide that may form as the molten metal exits the feed tube 406 into the mold cavity 412.

Each flow inducer 440 can include one or more magnetic sources. The flow inducers 440 can be positioned adjacent to and above the upper surface 402 of the molten metal 410. Although six flow inducers 440 are illustrated, any suitable number of flow inducers 440 may be used. As described above, each flow inducer 440 may be positioned above the upper surface 402 in any suitable way, including by suspension. Magnetic sources in the flow inducers 440 can include one or more permanent magnets rotatable about rotational axes to generate a changing magnetic field. Electromagnets may be used instead of or in addition to permanent magnets to generate the changing magnetic field.

The flow inducers 440 can be positioned around the feed tube 406 and oriented to induce metal flow 442 in a generally circular direction. As seen in FIG. 4, rotation of the flow inducers 440 in direction 446 induces metal flow 442 in a generally clockwise direction. Flow inducers 440 can be rotated in a direction opposite direction 446 to induce metal flow in a generally counter-clockwise direction. The rotational metal flow 442 can generate increased mixing within the molten metal 410, as described herein. The flow inducers 440 can be located in different orientations other than as shown.

In some cases, sufficient circular or rotational flow can be induced to form a vortex.

Figure 5:
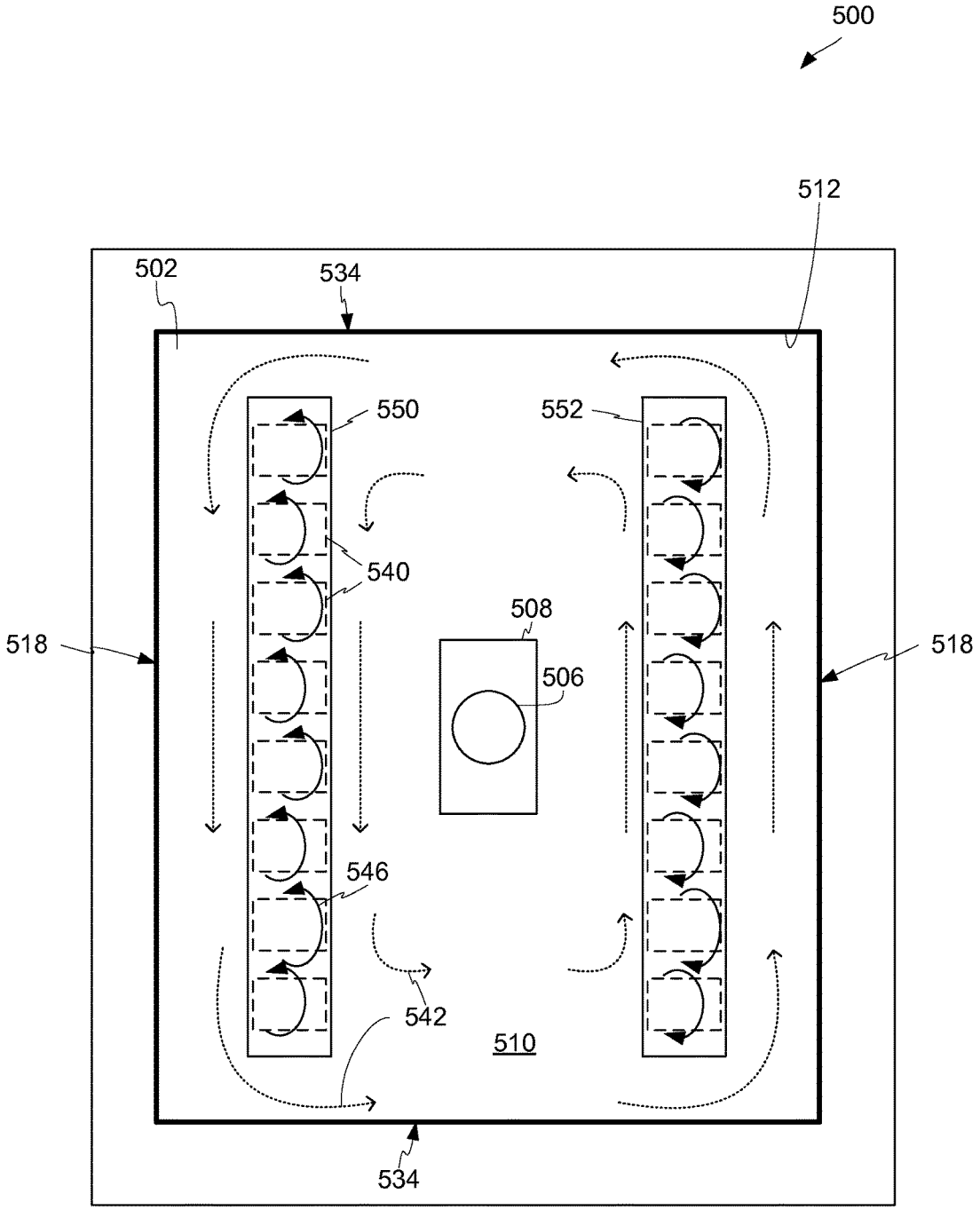
FIG. 5 is a top view of a metal casting system using flow inducers in a longitudinal orientation according to certain aspects of the present disclosure.

FIG. 5 is a top view of a metal casting system 500 using flow inducers 540 arranged in a longitudinal orientation according to certain aspects of the present disclosure. The flow inducers 540 are non-contacting molten flow inducers using rotating permanent magnets. Other non-contacting molten flow inducers can be used, such as electromagnetic flow inducers. The flow inducers 540 are shown housed in a first assemblage 550 and a second assemblage 552.

The mold cavity 512 is configured to contain molten metal 510 within a set of long walls 518 and short walls 534. While the mold cavity 512 is shown as being rectangular in shape, any other shaped mold cavity can be used. Molten metal 510 is introduced to the mold cavity 512 through feed tube 506. An optional skimmer 508 can be used to collect some metal oxide that may form as the molten metal exits the feed tube 506 into the mold cavity 512.

Each flow inducer 540 can include one or more magnetic sources. The flow inducers 540 can be positioned adjacent to and above the upper surface 502 of the molten metal 510. Although sixteen flow inducers 540 are illustrated spanning two assemblages 550, 552, any suitable number of flow inducers 540 and assemblages 550, 552 may be used. As described above, each flow inducer 540 may be positioned above the upper surface 502 in any suitable way, including by suspension. Magnetic sources in the flow inducers 540 can include one or more permanent magnets rotatable about rotational axes to generate a changing magnetic field. Electromagnets may be used instead of or in addition to permanent magnets to generate the changing magnetic field.

Each assemblage 550, 552 can be oriented laterally above the mold cavity 512, generally parallel to the long walls 518 and positioned between the long walls 518 and the feed tube 506. The flow inducers 540 can induce metal flow 542 in a generally circular direction. As seen in FIG. 5, rotation of the flow inducers 540 in direction 546 induces metal flow 542 in a generally counter-clockwise direction. Flow inducers 540 can be rotated in a direction opposite direction 546 to induce metal flow in a generally clockwise direction. The rotational metal flow 542 can generate increased mixing within the molten metal 510, as described herein. The flow inducers 540 and assemblages 550, 552 can be located in different orientations other than as shown.

Each flow inducer 540 can be operated out of phase from adjacent flow inducers 540 (e.g., with magnetic poles of a permanent magnet rotating 90°, 60°, 180°, or other amounts offset from an adjacent permanent magnet). Operating adjacent flow inducers 540 out of phase with one another can control harmonic frequency and the amplitude of a wave created in the molten metal 510.

Figure 6:
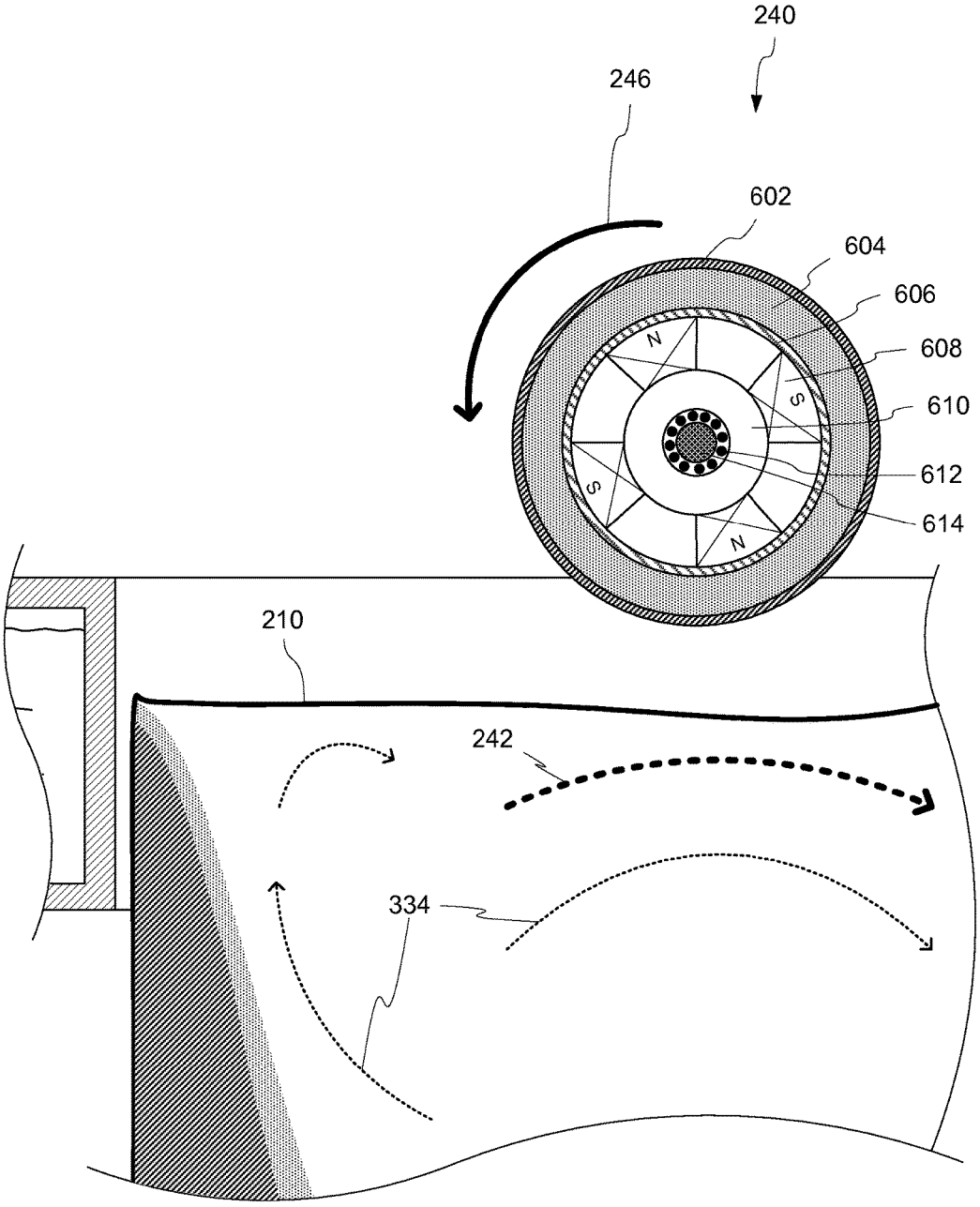
FIG. 6 is a close up elevation view of a flow inducer of FIGS. 2 and 3 according to certain aspects of the present disclosure.

FIG. 6 is a close-up, cross-sectional elevation view of a flow inducer 240 of FIGS. 2 and 3 according to certain aspects of the present disclosure. The flow inducer 240 can be rotated in direction 246 to induce molten flow 242 in the molten metal of the molten sump 306. The molten flow 242 can generate sympathetic flow 334 of molten metal deeper within the molten sump 306, as described herein.

As illustrated, a flow inducer 240 can include an outer shell 602. The outer shell 602 can be a radiant heat reflector, such as a polished metal shell or any other suitable radiant heat reflector. The flow inducer 240 can additionally include a conductive heat inhibitor 604. The conductive heat inhibitor 604 can be any suitable low-thermally conductive material, such as a refractory material or an aerogel or any other suitable low-thermally conductive material.

The flow inducer 240 can additionally include a middle shell 606 separating the permanent magnets 608 and the conductive heat inhibitor 604. One or more permanent magnets 608 can be positioned around an axle 614.

In some cases, the permanent magnets 608 can be rotationally free with respect to the axle 614. The permanent magnets 608 can be positioned around an inner shell 610 that is rotationally free with respect to the axle 614 through the use of bearings 612.

Other types and arrangements of magnetic sources can be used.

Figure 7:
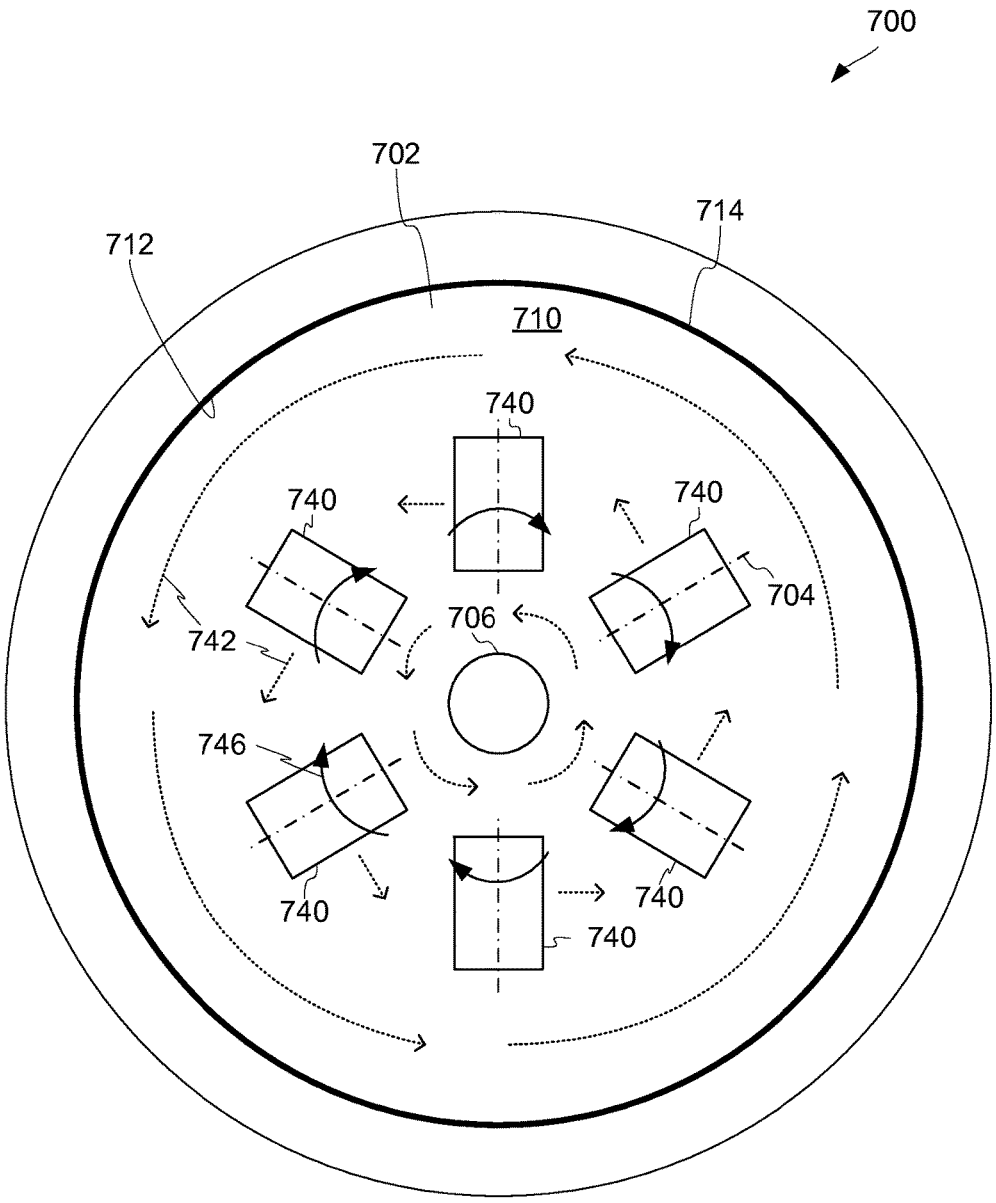
FIG. 7 is a top view of a metal casting system using flow inducers in a radial orientation within a circular mold cavity according to certain aspects of the present disclosure.

FIG. 7 is a top view of a metal casting system 700 using flow inducers 740 in a radial orientation within a circular mold cavity 712 according to certain aspects of the present disclosure. The flow inducers 740 are non-contacting molten flow inducers using rotating permanent magnets. Other non-contacting molten flow inducers can be used, such as electromagnetic flow inducers.

The circular mold cavity 712 is configured to contain molten metal 710 within a single, circular wall 714. While the mold cavity 712 is shown as being circular in shape, any other shaped mold cavity, with any number of walls, can be used. Molten metal 710 is introduced to the mold cavity 712 through feed tube 706. The metal casting system 700 is shown without the optional skimmer.

Each flow inducer 740 can include one or more magnetic sources. The flow inducers 740 can be positioned adjacent to and above the upper surface 702 of the molten metal 710. Although six flow inducers 740 are illustrated, any suitable number of flow inducers 740 may be used. As described above, each flow inducer 740 may be positioned above the upper surface 702 in any suitable way, including by suspension. Magnetic sources in the flow inducers 740 can include one or more permanent magnets rotatable about rotational axes 704 to generate a changing magnetic field. Electromagnets may be used instead of or in addition to permanent magnets to generate the changing magnetic field.

The flow inducers 740 can be positioned around the feed tube 706 and oriented to induce metal flow 742 in a generally circular direction. The rotational axes 704 of the flow inducers 740 can be positioned on (e.g., collinear with) radii extending from the center of the mold cavity 712. As seen in FIG. 7, rotation of the flow inducers 740 in direction 746 induces metal flow 742 in a generally counter-clockwise direction. Flow inducers 740 can be rotated in a direction opposite direction 746 to induce metal flow in a generally clockwise direction. The rotational metal flow 742 can generate increased mixing within the molten metal 710, as described herein. The flow inducers 740 can be located in different orientations other than as shown.

Figure 8:
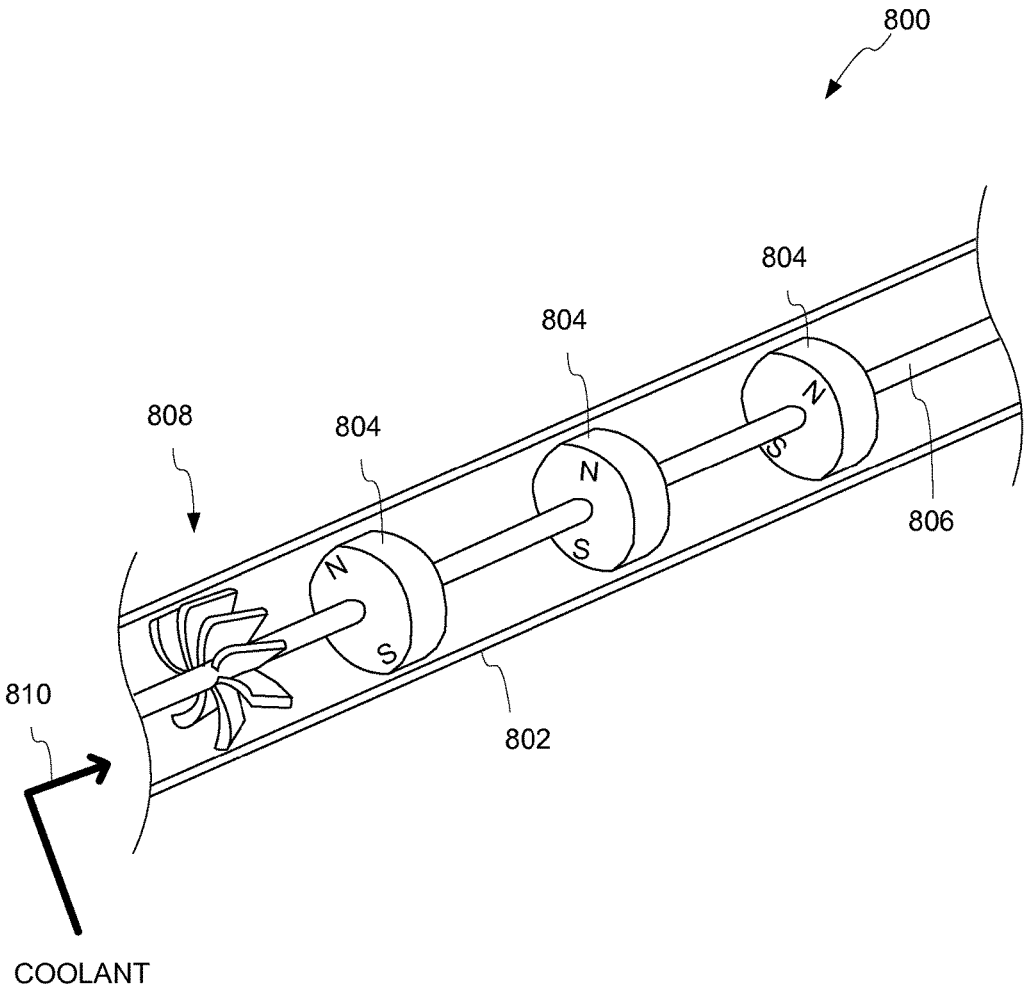
FIG. 8 is a schematic diagram of a flow inducer containing permanent magnets according to certain aspects of the present disclosure.

FIG. 8 is schematic diagram of a flow inducer 800 containing permanent magnets according to certain aspects of the present disclosure. The flow inducer 800 includes a shell 802 and permanent magnets 804. The permanent magnets 804 are rotatably fixed to an axle 806. The axle 806 can be driven by a motor or in any other suitable way.

In some cases, an impeller 808 can be rotatably fixed to the axle 806. As coolant is forced into the flow inducer 800 in direction 810, the coolant can pass over the impeller 808, causing the axle 806 to rotate, which causes the permanent magnets 804 to rotate. Additionally, the coolant will continue down the flow inducer 800, passing over or near the permanent magnets 804, cooling them. Examples of suitable coolant include air or other gases or fluids.

As seen in FIG. 8, adjacent permanent magnets 804 can have rotationally offset (e.g., staggered) north poles. For example, the north poles of sequential magnets can be approximately 60° offset from the adjacent magnets. Other offset angles can be used. The staggered poles can limit resonation in the molten metal due to magnetic movement of the molten metal. In other cases, the poles of adjacent magnets are not offset.

Figure 9:
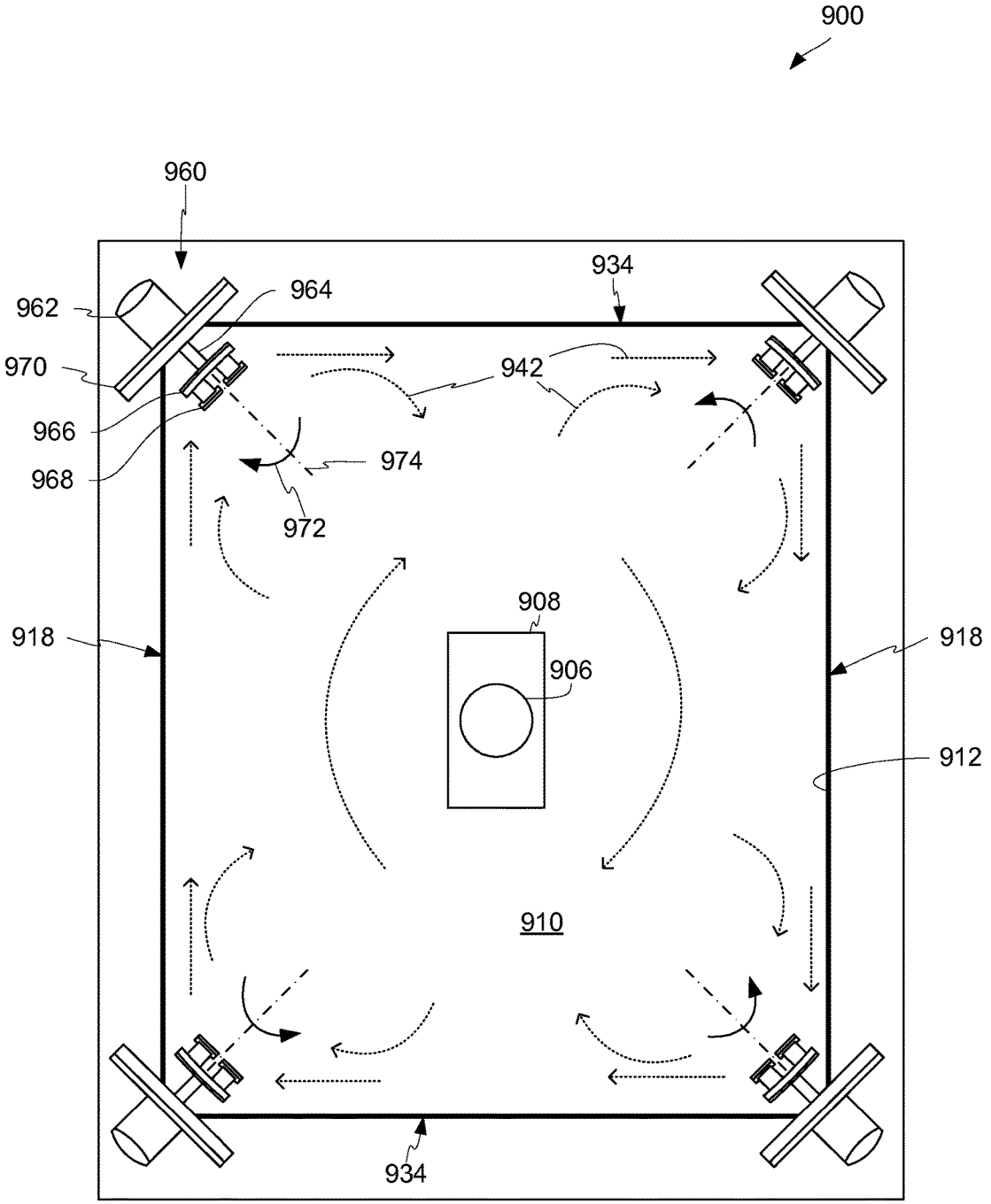
FIG. 9 is a top view of a metal casting system using corner flow inducers at the corners of the mold cavity according to certain aspects of the present disclosure.

FIG. 9 is a top view of a metal casting system 900 using corner flow inducers 960 at the corners of the mold cavity 912 according to certain aspects of the present disclosure. The corner flow inducers 960 are non-contacting molten flow inducers using rotating permanent magnets. Other non-contacting molten flow inducers can be used, such as electromagnetic flow inducers.

The mold cavity 912 is configured to contain molten metal 910 within a set of long walls 918 and short walls 934. A corner exists where a wall meets an adjacent wall. While the mold cavity 912 is shown as being rectangular in shape and having 90° corners, any other shaped mold cavity can be used with any number of corners having any angular breadth. Molten metal 910 is introduced to the mold cavity 912 through feed tube 906. An optional skimmer 908 can be used to collect some metal oxide that may form as the molten metal exits the feed tube 906 into the mold cavity 912.

Corner flow inducers 960 can include one or more magnetic sources to generate changing magnetic fields. A corner flow inducer 960 can include a rotating plate 966 coupled to a motor 962 by a shaft 964. Optionally, the rotating plate can be rotated by other mechanisms. The shaft can be supported by a support 970. The support 970 can be mounted to the walls of the mold cavity 912 or otherwise positioned adjacent the mold cavity 912. The rotating plate 966 can include one or more permanent magnets 968 that are positioned radially apart from the rotational axis 974 of the rotating plate 966. The rotational axis 974 of the rotating plate 966 can be angled slightly towards the surface of the molten metal 910, such that rotation of the rotating plate 966 (e.g., in direction 972) will sequentially move the one or more permanent magnets 968 towards and away from the surface of the molten metal 910 near the corner of the mold cavity 912, generating a changing magnetic field in the corner of the mold cavity 912. In other cases, corner flow inducers 960 can include electromagnetic sources to generate changing magnetic fields in the corners of the mold cavities 912.

Rotation of the rotating plates 966 in direction 972 can induce molten flow 942 in the molten metal 910 through the corner (e.g., flow generally clockwise through the corner). For example, rotation of the rotating plates 966 as depicted in FIG. 9 can induce molten flow 942 from the left side of each corner flow inducer 960, through the corner, and out past the right side of each corner flow inducer 960, as seen looking at the corner flow inducer 960 from the feed tube 906. Rotation in an opposite direction can induce molten flow in the opposite direction.

Figure 10:
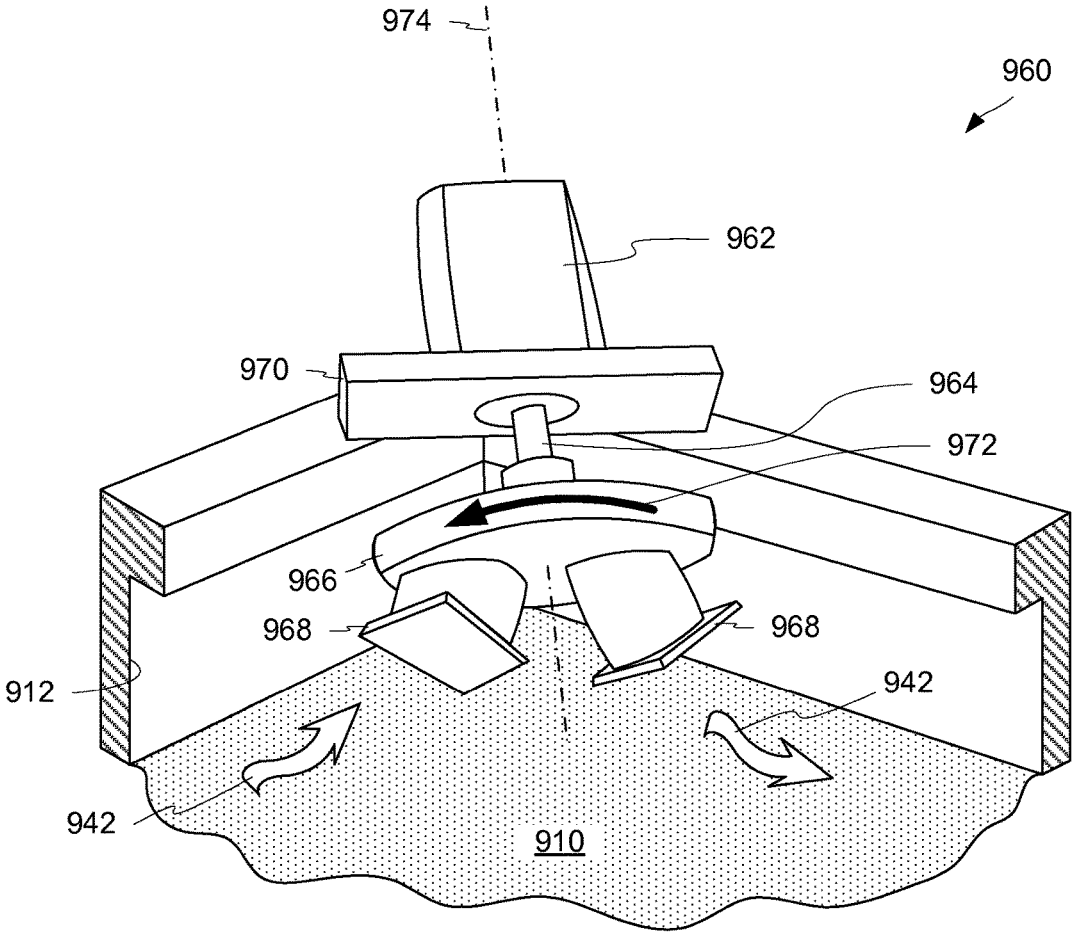
FIG. 10 is an axonometric view depicting a corner flow inducer of FIG. 9 according to certain aspects of the present disclosure.

FIG. 10 is an axonometric view depicting a corner flow inducer 960 of FIG. 9 according to certain aspects of the present disclosure. The corner flow inducer 960 includes a support 970 that is secured to the walls of the mold cavity 912. A motor 962 drives a shaft 964 that rotates a rotating plate 966 in direction 972. Optionally, the rotating plate can be rotated by other mechanisms. Permanent magnets 968 are mounted to the rotating plate 966 to rotate along with the rotating plate 966. The rotating plate 966 rotates about a rotational axis 974 that is angled towards the surface of the molten metal 910. In alternate cases, the rotational axis 974 is not angled, but is rather parallel with the surface of the molten metal 910.

As the rotating plate 966 rotates, one of the permanent magnets 968 begins to move closer to the surface of the molten metal 910 as the other of the permanent magnets 968 begins to move away from the surface of the molten metal 910. As the first of the permanent magnets 968 is rotated to its closest point near the surface of the molten metal 910, the other of the permanent magnets 968 is at its furthest point from the surface of the molten metal 910. The rotation continues to bring the other of the permanent magnets 968 towards the surface of the molten metal 910 as the first of the permanent magnets 968 is rotated away from the surface of the molten metal 910.

The fluctuating distances of the permanent magnets 968 from the surface of the molten metal 910 generate a changing magnetic field, which induces molten flow 942 of the molten metal 910 through the corner. For example, rotation of the rotating plate 966 as depicted in FIG. 10 can induce molten flow 942 from the left side of the corner, through the corner, and out the right side of the corner. Rotation in an opposite direction can induce molten flow in the opposite direction.

Figure 11:
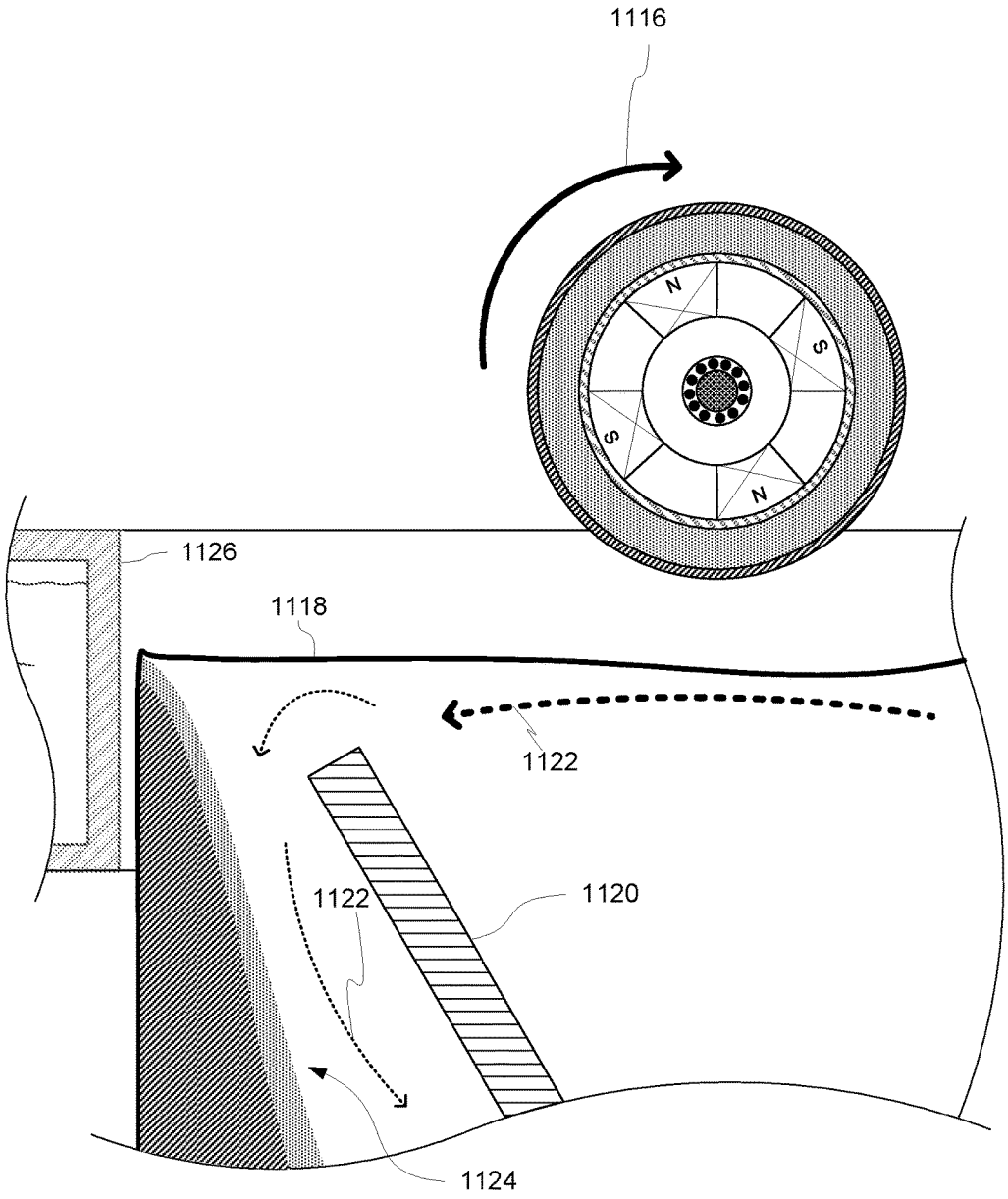
FIG. 11 is a close-up, cross-sectional elevation view of a flow inducer used with a flow director according to certain aspects of the present disclosure.

FIG. 11 is a close-up, cross-sectional elevation view of a flow inducer 1100 used with a flow director 1120 according to certain aspects of the present disclosure. The flow inducer 1100 can be similar to the flow inducer 240 of FIG. 2 or can be any other suitable flow inducer (e.g., with other types and arrangements of magnetic sources). The flow inducer 1100 can be rotated in direction 1116 to induce molten flow 1122 in the molten metal of the molten sump 1118. The molten flow 1122 can pass over the top of the flow director 1120, and continue down the solidifying interface 1124.

The flow director 1120 can be made of any material suitable for submersion in the molten metal 1118. The flow director 1120 can be wing-shaped or otherwise shaped to induce flow down the solidifying interface 1124 (e.g., to increase flow in the low-lying stagnation region near the solidifying interface 1124 and/or to aid in ripening of metal crystals). The flow director 1120 can extend to any suitable depth within the sump.

In some cases, the flow director 1120 is coupled to the mold body 1126, such as through movable arms (not shown). In some cases, the flow director 1120 is coupled to a carrier (not shown) that optionally also carries the flow inducer 1100. In this way, the distances between the flow inducer 1100 and the flow director 1120 can be maintained steady. In some cases, movable arms (not shown) coupling the flow director 1120 to the carrier or the mold body 1126 can allow the flow director 1120 to move (e.g., for positioning within the molten sump 1118, and/or for insertion/removal to/from the molten sump 1118).

Figure 12:
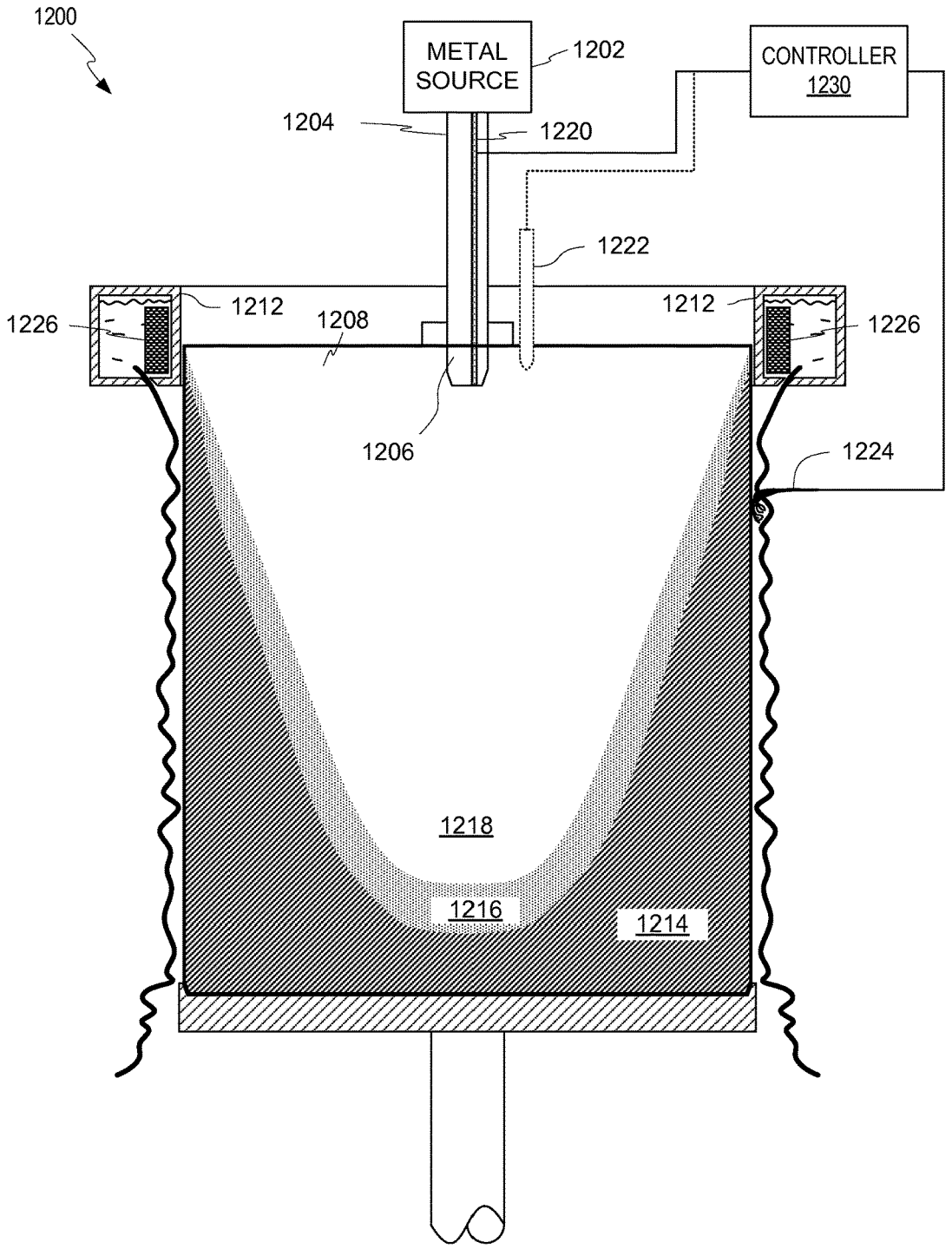
FIG. 12 is a cross-sectional diagram of a metal casting system using a multi-part flow inducer employing Fleming's Law for molten metal flow according to certain aspects of the present disclosure.

FIG. 12 is a cross-sectional diagram of a metal casting system 1200 using a multi-part flow inducer employing Fleming's Law for molten metal flow according to certain aspects of the present disclosure. The multi-part flow inducer includes at least one magnetic field source 1226 (e.g., a pair of permanent magnets) and a pair of electrodes. By simultaneously applying an electrical current and a magnetic field through the molten metal 1208, force can be induced in the molten metal perpendicular to the directions of the electrical current and the magnetic field.

Molten metal flows from the metal source 1202, down the feed tube 1204, and out the dispenser 1206. The metal in the mold cavity 1212 can include a solidified metal region 1214, a transitional metal region 1216, and a molten metal region 1218.

The magnetic field sources 1226 can be located anywhere suitable for inducing a magnetic field through at least a portion of the molten metal region 1218. In some cases, the magnetic field sources 1226 can include static permanent magnets, rotating permanent magnets, or any combination thereof. In some cases, the magnetic field sources 1226 can be positioned in, on, or around the mold cavity 1212.

The pair of electrodes can be coupled to a controller 1230. A bottom electrode 1224 can contact the solidified metal region 1214 as the cast product is lowered. The bottom electrode 1224 can be any suitable electrode for contacting the solidified metal region 1214 in a sliding fashion. In some cases, the bottom electrode 1224 is a brush-shaped electrode, such as an electroplating brush. In some cases, the top electrode can be an electrode 1220 built into the dispenser 1206. In some cases, the top electrode can be an electrode 1222 that is submergible into the molten metal 1208.

Figure 13:
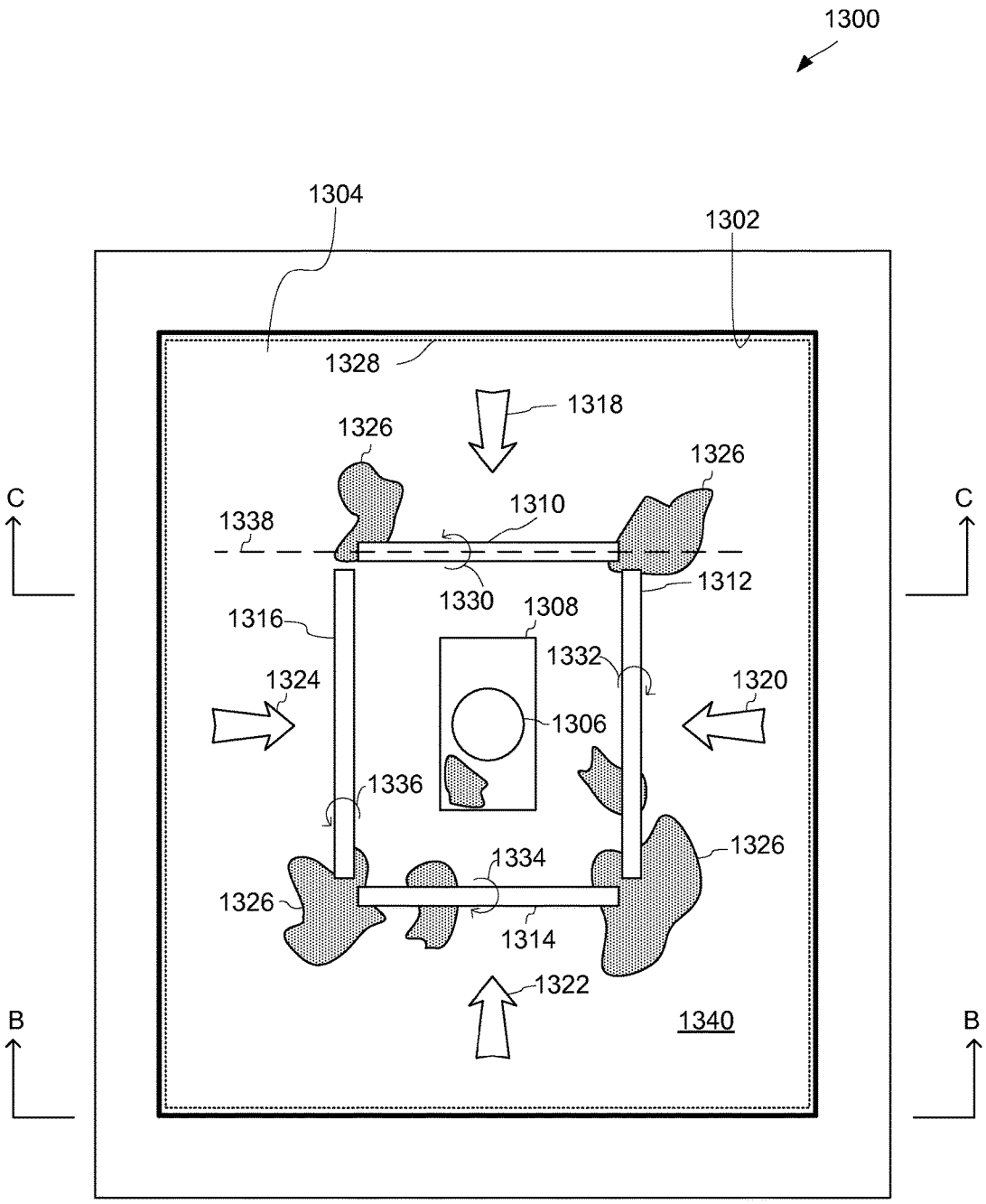
FIG. 13 is a top view of a mold during a steady-state phase of casting according to certain aspects of the present disclosure.

FIG. 13 is a top view of a mold 1300 during a steady-state phase of casting according to certain aspects of the present disclosure. As used herein, a mold 1300 is a form of molten metal receptacle. The mold 1300 is configured to contain molten metal 1304 within the walls 1302 of the mold 1300. As seen in FIG. 13 starting from the top of the page and moving in a clockwise direction, the walls 1302 include a first wall, a second wall, a third wall, and a fourth wall surrounding the molten metal 1304. A meniscus 1328 of molten metal 1304 is present adjacent the walls 1302 of the mold 1300. Molten metal 1304 is introduced to the mold 1300 by dispenser 1306. An optional skimmer 1308 can be used to collect some metal oxide that may form as the molten metal exits the dispenser 1306 into the mold 1300.

One or more magnetic sources, such as magnetic sources 1310, 1312, 1314, 1316, are positioned above the upper surface 1340 of the molten metal 1304. Although four magnetic sources are illustrated, any suitable number of magnetic sources may be used, including more or fewer than four. As described above, magnetic sources 1310, 1312, 1314, 1316 may be positioned above the upper surface 1340 in any suitable way, including by suspension. Magnetic source 1310 includes one or more permanent magnets rotatable about axis 1338 to generate an alternating magnetic field. Electromagnets may be used instead of or in addition to permanent magnets to generate the alternating magnetic field. Magnetic source 1310 can be rotated in direction 1330 to induce eddy currents in the molten metal 1304 in direction 1318. Likewise, magnetic sources 1312, 1314, 1316 can be similarly constructed and positioned and rotated in directions 1332, 1334, 1336, respectively, to generate eddy currents in the molten metal 1304 in directions 1320, 1322, 1324, respectively. Through the collective eddy currents induced in the molten metal 1304 in directions 1318, 1320, 1322, 1324, metal oxide 1326 supported by the upper surface 1340 of the molten metal 1304 is directed towards the dispenser 1306 at the center of the upper surface 1340. This control of the metal oxide 1326 helps keep the metal oxide 1326 from rolling over the meniscus 1328.

Figure 14:
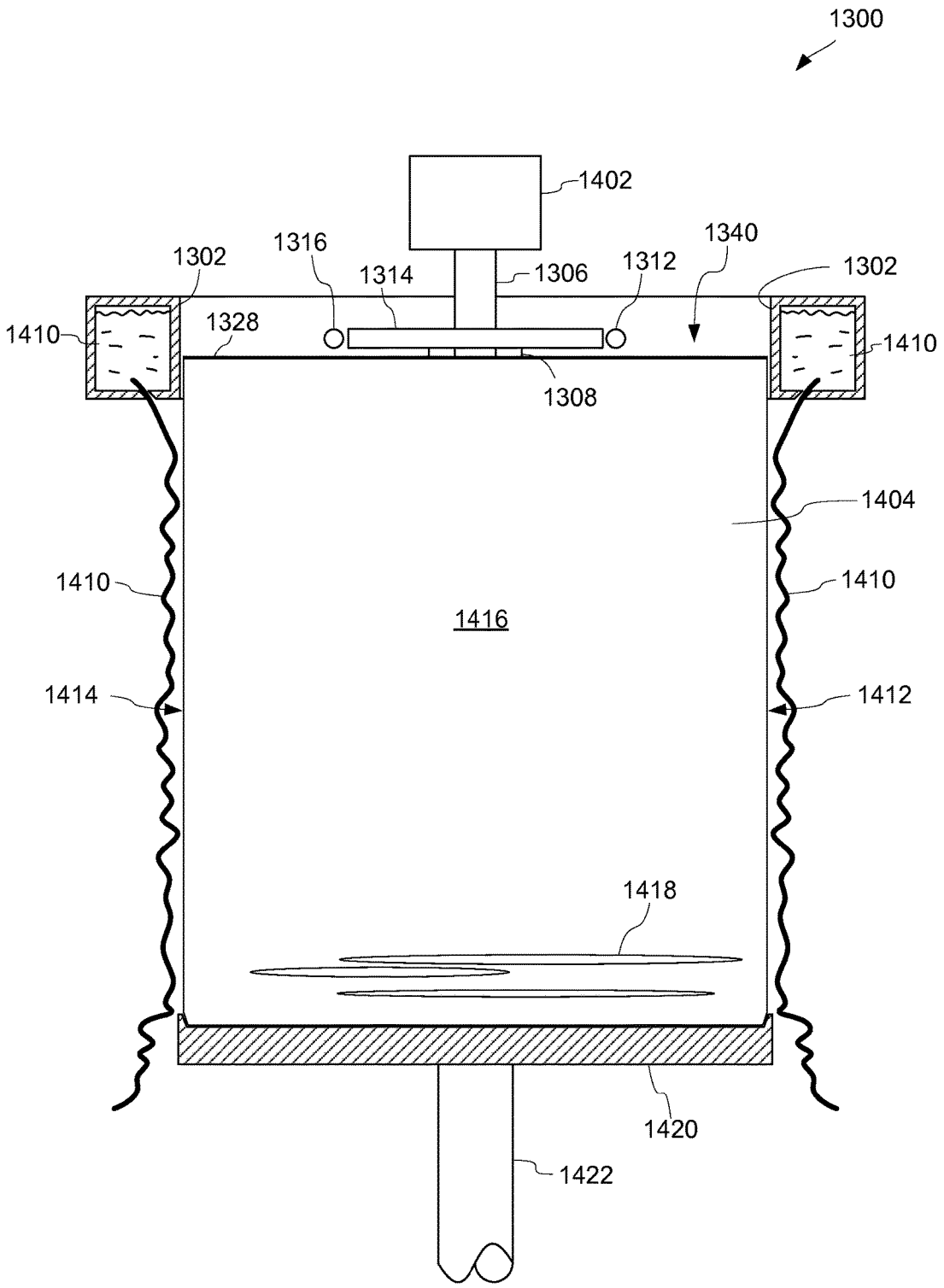
FIG. 14 is a cut-away view of the mold of FIG. 13 taken along line B-B during the steady-state phase, according to certain aspects of the present disclosure.

FIG. 14 is a cut-away view of the mold 1300 of FIG. 13 taken along line B-B during the steady-state phase, according to certain aspects of the present disclosure. A tundish 1402 can supply molten metal down a dispenser 1306. The optional skimmer 1308 can be used around the dispenser 1306. During an initial phase, the bottom block 1420 may be lifted by a hydraulic cylinder 1422 to meet the walls 1302 of the mold 1300. As molten metal begins to solidify within the mold, the bottom block 1420 can be steadily lowered. The cast metal 1404 can include sides 1412, 1414, 1416 that have solidified, while molten metal added to the cast can be used to continuously lengthen the cast metal 1404. The portion of the cast metal 1404 first formed (e.g., the portion near the bottom block 1420) is known as the bottom or butt of the cast metal 1404 and which may be removed and discarded after the cast metal 1404 is formed.

The meniscus 1328 is seen at the upper surface 1340 adjacent the walls 1302. In some cases, the walls 1302 can define a hollow space and may contain a coolant 1410, such as water. The coolant 1410 can exit as jets from the hollow space and flow down the sides 1412, 1414 of the cast metal 1404 to help solidify the cast metal 1404. The solidified third side 1416 of the cast metal 1404 is seen in FIG. 14. The third side 1416 includes metal oxide inclusions 1418 near the bottom of the cast metal 1404. As described above, metal oxide can have been induced to roll over the meniscus 1328 during the initial phase, which causes metal oxide inclusions 1418 to form near the bottom of the cast metal 1404. Because the casting process is seen in a steady-state phase in FIG. 14, there are minimal metal oxide inclusions 1418 being formed on the sides of the cast metal 1404 due to rotation of magnetic sources 1310, 1312, 1314, 1316.

Figure 15:
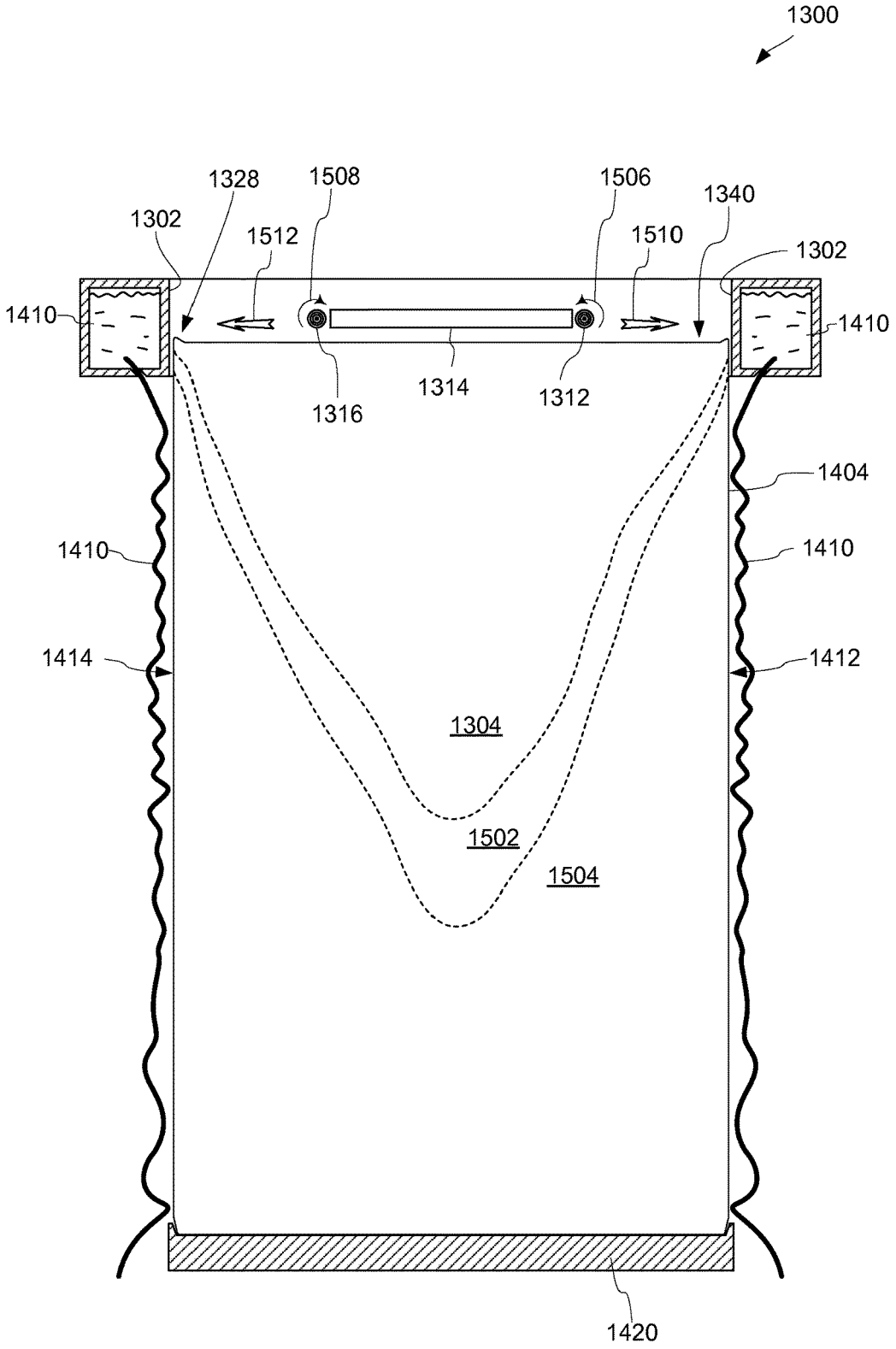
FIG. 15 is a cutaway view of the mold of FIG. 13 taken along line C-C during the final phase of casting, according to certain aspects of the present disclosure.

FIG. 15 is a cutaway view of the mold 1300 of FIG. 13 taken along line C-C during the final phase of casting, according to certain aspects of the present disclosure. The cutaway view shows the cast metal 1404 being comprised of molten metal 1304, solidified metal 1504, and transitional metal 1502. The transitional metal 1502 is metal that is between the molten and solidified states.

The meniscus 1328 is seen at the upper surface 1340 adjacent the walls 1302. In some cases, the walls 1302 define a hollow space and can contain a coolant 1410, such as water. The coolant 1410 can exit as jets from the hollow space and flow down the sides 1412, 1414 of the cast metal 1404 to help solidify the cast metal 1404.

During the final phase of casting, the magnetic sources 1310, 1312, 1314, 1316 can rotate in directions opposite from which they rotate during the steady-state phase. For example, magnetic sources 1312, 1316 can rotate in directions 1506, 1508, respectively, to create eddy currents in the upper surface 1340 in directions 1510, 1512, respectively. These eddy currents can help urge metal oxide towards the meniscus 1328 so that the metal oxide may roll over. Magnetic sources 1310, 1312, 1314, 1316 may be rotating in these same directions during the initial phase of casting, as well.

Figure 16:
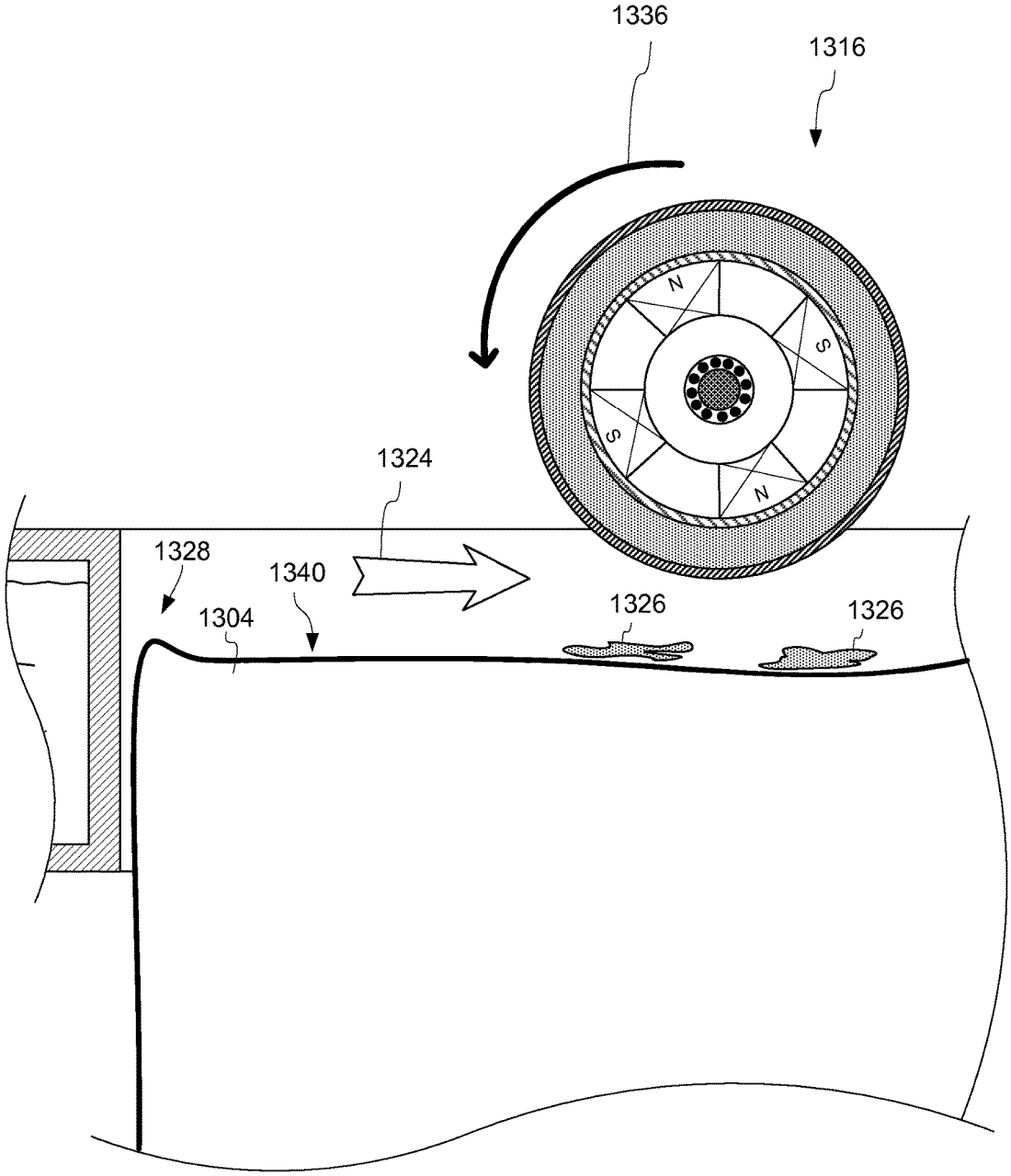
FIG. 16 is a close up elevation view of a magnetic source above molten metal according to certain aspects of the present disclosure.

FIG. 16 is a close up elevation view of a magnetic source 1316 above molten metal 1304 according to certain aspects of the present disclosure. The magnetic source 1316 can be the same as or similar to the flow inducer 240 of FIG. 6 and can include any variations as described above. The magnetic source 1316 can be rotated in direction 1336 to induce eddy currents in the upper surface 1340 of the molten metal 1304 in direction 1324. The eddy currents can help inhibit metal oxide 1326 on the upper surface 1340 from reaching and rolling over the meniscus 1328 by directing the metal oxide 1326 toward the center of the molten metal 1304.

Figure 17:
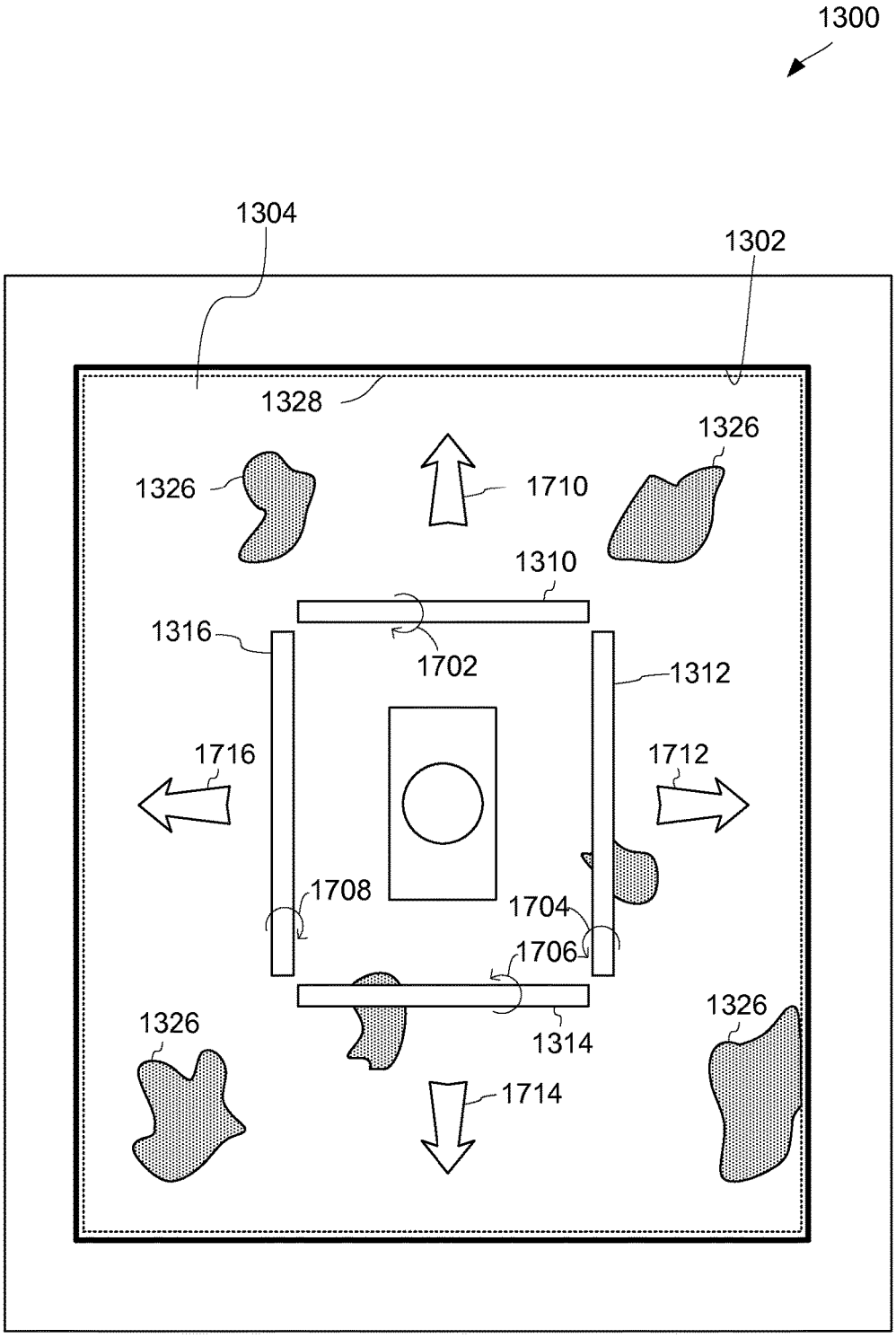
FIG. 17 is a top view of the mold of FIG. 13 during an initial phase of casting according to certain aspects of the present disclosure.

FIG. 17 is a top view of the mold 1300 of FIG. 13 during an initial phase of casting according to certain aspects of the present disclosure. The mold 1300 contains molten metal 1304 within the walls 1302 of the mold 1300.

During the initial phase of casting, magnetic sources 1310, 1312, 1314, 1316 can rotate in directions 1702, 1704, 1706, 1708, respectively, to induce eddy currents in the molten metal 1304 in directions 1710, 1712, 1714, and 1716, respectively. These eddy currents can urge the metal oxide 1326 towards the meniscus 1328, inducing roll over.

Figure 18:
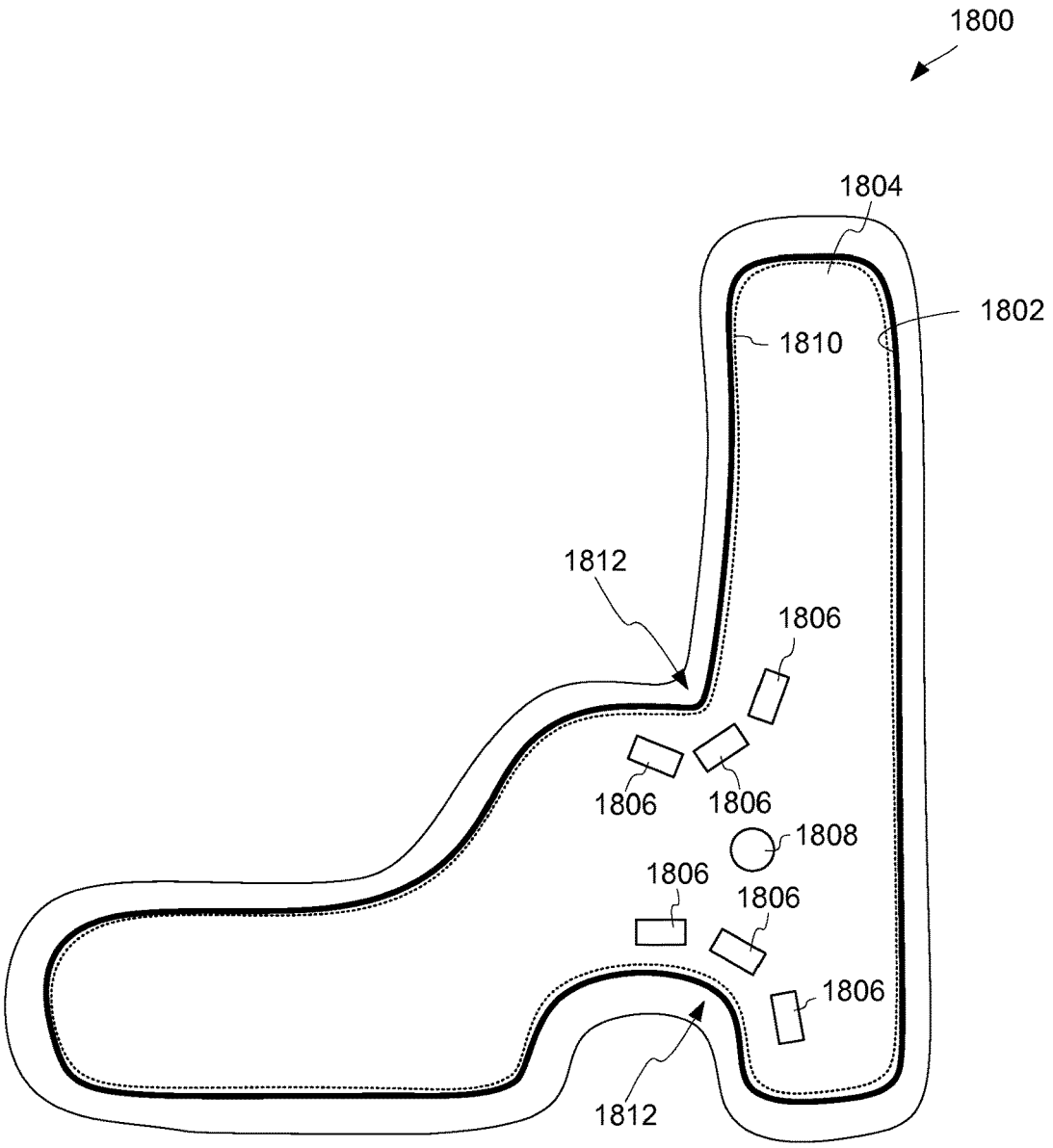
FIG. 18 is a top view of an alternate mold according to certain aspects of the present disclosure.

FIG. 18 is a top view of an alternate mold 1800 according to certain aspects of the present disclosure. Mold 1800 includes a complex-shaped wall 1802. Molten metal 1804 is introduced into the mold 1800 by a dispenser 1808. One or more magnetic sources 1806 are positioned between the dispenser 1808 and the wall 1802 to control metal oxide migration along the upper surface of the molten metal 1804 (e.g., to inhibit and/or induce rollover of metal oxide over the meniscus 1810), as desired.

In cases with complex-shaped walls 1802, the complex shape of the walls 1802 may include bends 1812 (e.g., inward or outward bends). Magnetic sources 1806 may be positioned around the bends 1812 such that the axis of each magnetic source 1806 is approximately perpendicular to the shortest line between the center of the magnetic source 1806 and the walls 1802 (e.g., parallel with the closest portion of the wall). Such an arrangement may allow the magnetic sources 1806 to induce eddy currents that are directed towards or away from the wall.

Figure 19:
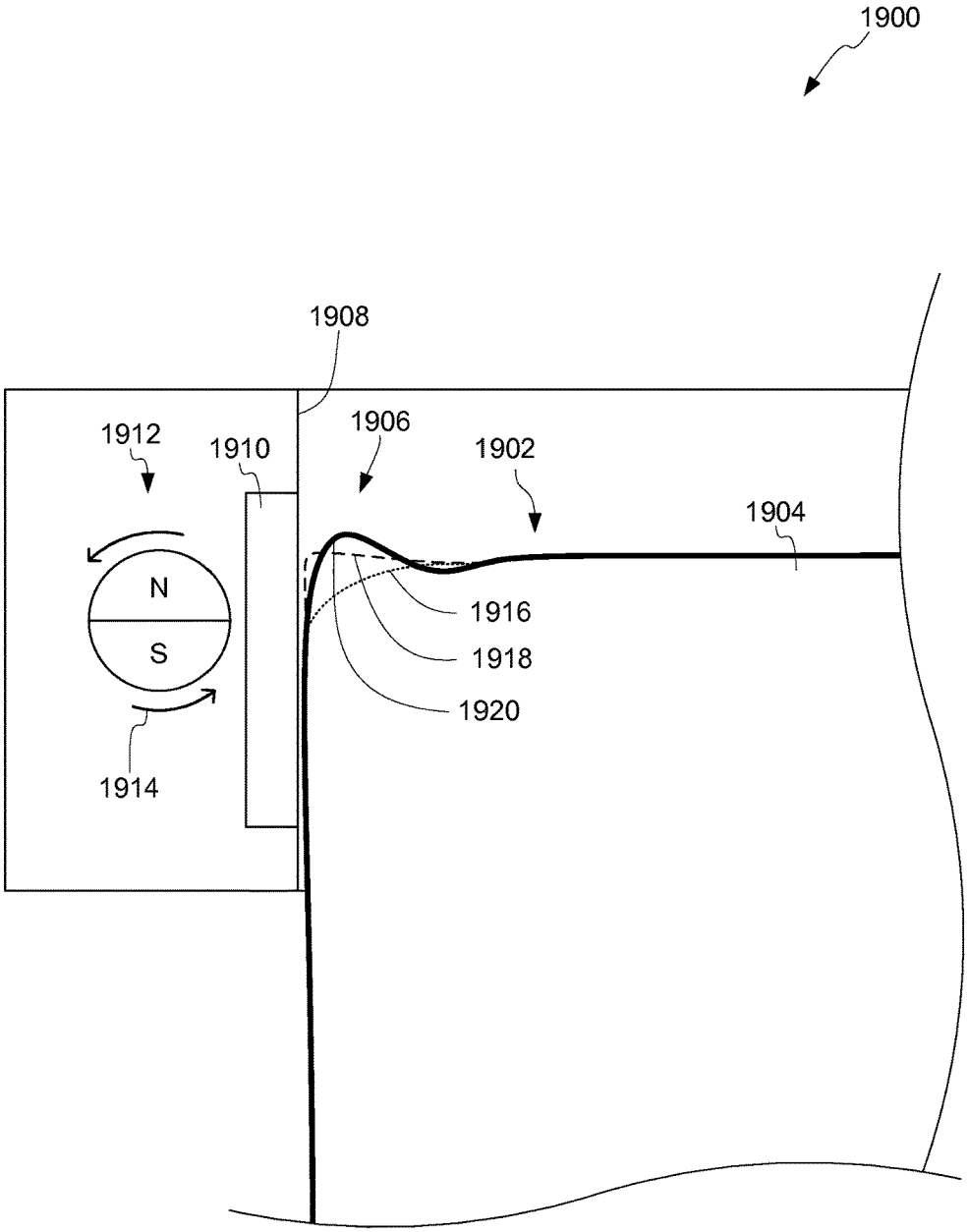
FIG. 19 is a schematic diagram of a magnetic source adjacent a meniscus of molten metal according to certain aspects of the present disclosure.

FIG. 19 is a schematic diagram of a magnetic source 1912 adjacent a meniscus 1906 of molten metal according to certain aspects of the present disclosure. The magnetic source 1912 can be located within the walls 1908 of a mold 1900. The mold 1900 can include a band of graphite 1910 used to form a primary solidifying layer of the cast metal. A meniscus 1906 can be located adjacent where the upper surface 1902 of the molten metal 1904 meets the walls 1908.

Under normal conditions (e.g., without using a magnetic source 1912 adjacent the meniscus 1906), the meniscus 1906 may have a curve 1918 that is generally flat. In cases where a magnetic source 1912 is adjacent the meniscus 1906, the magnetic source 1912 can induce a height change in the meniscus 1906. When the magnetic source 1912 rotates in direction 1914, the meniscus 1906 may be raised and may follow curve 1920. When the magnetic source 1912 rotates in a direction opposite direction 1914, the meniscus 1906 may be lowered and may follow curve 1916.

When the meniscus 1906 is raised to curve 1920, the meniscus 1906 can provide a physical barrier to the rollover of metal oxide on the upper surface 1902, which can be advantageous during the steady-state phase of casting. When the meniscus 1906 is lowered to curve 1916, the meniscus 1906 can provide a reduced barrier to rollover of metal oxide on the upper surface 1902, which can be advantageous during the initial phase and/or final phase of casting.

In some cases, the magnetic source 1912 within walls 1908 can be cooled using coolant (not shown), such as water, already present in and/or flowing through the walls 1908.

In some cases where the magnetic source 1912 is rotating in a direction opposite direction 1914, the grain structure of the resultant cast metal can be altered by adjusting the velocity with which molten metal 1904 approaches the solid/liquid interface (not shown).

Figure 20:
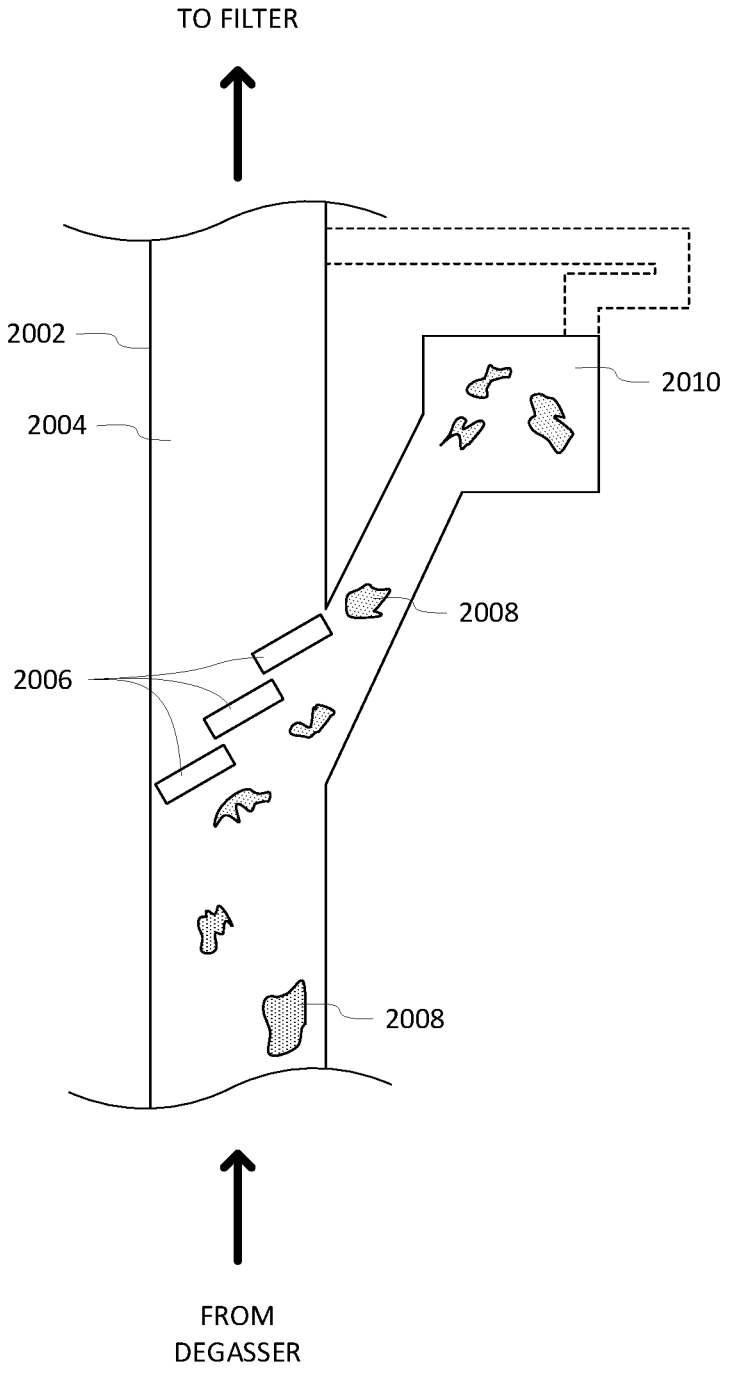
FIG. 20 is a top view of a trough for transporting molten metal according to certain aspects of the present disclosure.

FIG. 20 is a top view of a trough 2002 for transporting molten metal 2004 according to certain aspects of the present disclosure. As used herein, a trough 2002 is a type of molten metal receptacle. One or more magnetic sources 2006 are positioned above the upper surface of the molten metal 2004 to control migration of metal oxide 2008 along the upper surface of the molten metal 2004. As the one or more magnetic sources 2006 create alternating magnetic fields, they induce eddy currents in the molten metal 2004 in a direction normal to their center axes (e.g., axes of rotation for a rotating permanent magnet magnetic source). The eddy currents can divert the metal oxide 2008 down an alternate path of the trough 2002, such as to a collection area 2010.

Metal oxides 2008 in the collection area 2010 can be filtered out manually or automatically. In some cases, the collection area 2010 can reconnect to the main path of the trough 2002.

In some cases, magnetic source 2006 can be positioned to divert metal oxide 2008 as the molten metal 2004 travels between a degasser and a filter. By diverting the metal oxides 2008 to a collection area 2010 for removal, the molten metal 2004 can be processed by the filter without premature clogging and/or plugging of the filter by the metal oxides 2008.

Figure 21:
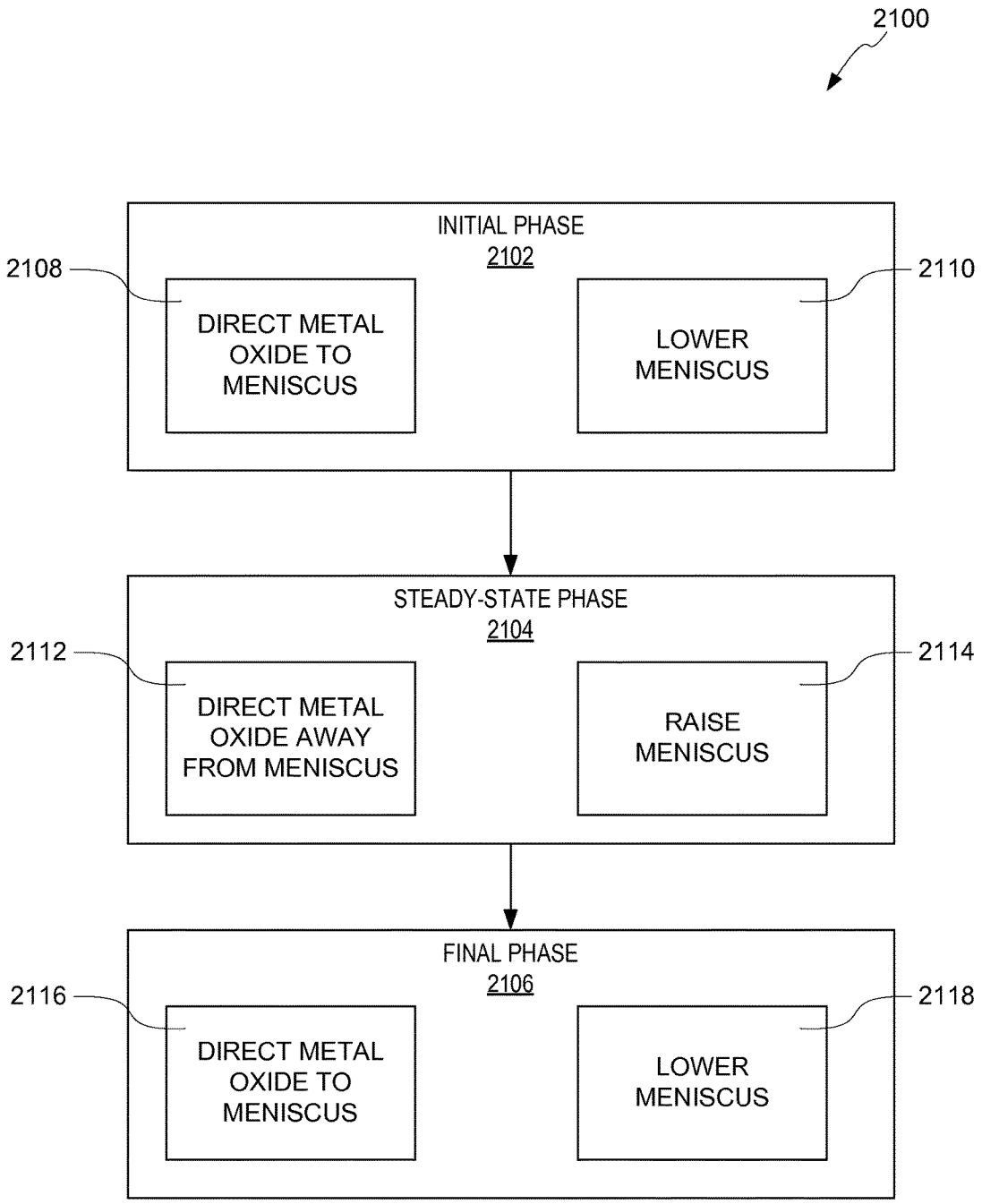
FIG. 21 is a flow chart depicting a casting process according to certain aspects of the present disclosure.

FIG. 21 is a flow chart depicting a casting process 2100 according to certain aspects of the present disclosure. The casting process 2100 can include an initial phase 2102 followed by a steady-state phase 2104, followed by a final phase 2106, as described in further detail above.

During the initial phase 2102, it can be desirable to direct metal oxide towards the sides of the forming cast metal (e.g., encourage metal oxide rollover). During the initial phase 2102, one or more magnetic sources adjacent an upper surface of molten metal can direct metal oxide to the meniscus at block 2108. If desired, during the initial phase 2102, one or more magnetic sources adjacent the meniscus can lower the meniscus at block 2110.

During the steady-state phase 2104, it can be desirable to direct metal oxide away from the sides of the forming cast metal (e.g., inhibit metal oxide rollover), collecting the metal oxide on the surface of the molten metal until the final phase 2106. During the steady-state phase 2104, one or more magnetic sources adjacent an upper surface of molten metal can direct metal oxide away from the meniscus at block 2112. If desired, during the steady-state phase 2104, one or more magnetic sources adjacent the meniscus can raise the meniscus at block 2114.

During the final phase 2106, it can be desirable to direct metal oxide towards the sides of the forming cast metal (e.g., encourage metal oxide rollover). During the final phase 2106, one or more magnetic sources adjacent an upper surface of molten metal can direct metal oxide to the meniscus at block 2116. If desired, during the final phase 2106, one or more magnetic sources adjacent the meniscus can lower the meniscus at block 2118.

In various examples, one or more of the blocks 2108, 2110, 2112, 2114, 2116, 2118 disclosed above may be omitted from their respective phases in any combination.

The embodiments and examples described herein allow metal oxide migration to be better controlled on the surface of molten metal.

Various flow inducers used in various orientations have been described herein for inducing molten flow and controlling metal oxides. While examples of certain flow inducers and orientations are given with reference to the figures contained herein, it will be understood that any combination of the flow inducers and any combination of flow inducer placement or orientation can be used together to achieve desired results (e.g., mixing, metal oxide control, or any combination thereof). As one non-limiting example, the corner flow inducers 960 of FIG. 9 can be used with the flow inducers 240 of FIG. 2 to produce a desired molten flow.

The disclosure provided herein enables non-contact molten flow control of molten metal. The flow control described herein can enable the casting of ingots that have a more desirable crystalline structure and that more desirable properties for downstream rolling or other processing.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is an apparatus comprising a mold for accepting molten metal; and at least one non-contact flow inducer positioned above a surface of the molten metal for generating a changing magnetic field proximate the surface of the molten metal that is sufficient to induce molten flow in the molten metal.

Example 2 is the apparatus of example 1, wherein the at least one non-contact flow inducer includes a first non-contact flow inducer positioned opposite a mold centerline from and parallel with a second non-contact flow inducer.

Example 3 is the apparatus of examples 1 or 2, wherein the at least one non-contact flow inducer is positioned proximate a corner of the mold for inducing the molten flow through the corner of the mold.

Example 4 is the apparatus of example 3, wherein the at least one non-contact flow inducer includes a plurality of permanent magnets positioned on a rotating plate that rotates about a rotational axis.

Example 5 is the apparatus of examples 1-4, wherein the at least one non-contact flow inducer comprises at least one permanent magnet rotating about an axis.

Example 6 is the apparatus of example 5, wherein the axis is positioned parallel to a mold centerline.

Example 7 is the apparatus of example 5, wherein the axis is positioned along a radius extending from a center of the mold.

Example 8 a metal product cast using the apparatus of examples 1-7.

Example 9 is a method comprising introducing molten metal into a mold cavity; generating a changing magnetic field proximate an upper surface of the molten metal; and inducing molten flow in the molten metal by generating the changing magnetic field.

Example 10 is the method of example 9, further comprising inducing sympathetic flow in the molten metal by inducing the molten flow.

Example 11 is the method of example 10, wherein inducing the sympathetic flow comprises inducing a sympathetic flow sufficient to mix the molten metal and reduce a thickness of a transitional metal region to approximately less than 3 millimeters.

Example 12 is the method of example 10, wherein inducing the sympathetic flow comprises inducing a sympathetic flow sufficient to mix the molten metal and reduce a thickness of a transitional metal region to approximately less than 1 millimeter.

Example 13 is the method of examples 9-12, wherein inducing the molten flow includes inducing a first molten flow towards a mold centerline of the mold cavity; and inducing a second molten flow towards the mold centerline and in a direction opposite the first molten flow.

Example 14 is the method of examples 9-13, wherein inducing the molten flow includes inducing the molten flow in a generally circular direction.

Example 15 is the method of examples 9-14, wherein inducing the molten flow includes inducing the molten flow through a corner of the mold cavity.

Example 16 is a metal product cast using the method of examples 9-15.

Example 17 is a system comprising a mold for accepting molten metal; a non-contacting flow inducer positioned directly above a surface of the molten metal; and a magnetic source included in the non-contacting flow inducer for generating a changing magnetic field sufficient to induce molten flow under the surface of the molten metal.

Example 18 is the system of example 17, wherein the magnetic source includes at least one permanent magnet rotating about a rotational axis at a speed between approximately 10 revolutions per minute and approximately 500 revolutions per minute.

Example 19 is the system of examples 17 or 18, wherein the non-contacting flow inducer is oriented to induce the molten flow in a direction parallel a wall of the mold.

Example 20 is the system of examples 17-19, wherein the non-contacting flow inducer is oriented to induce the molten flow in a direction perpendicular a radius extending from a center of the mold.

Example 21 is an apparatus comprising a mold for accepting molten metal; and at least one magnetic source positioned above the mold for generating an alternating magnetic field proximate a surface of the molten metal that is sufficient to direct movement of metal oxides on the surface of the molten metal.

Example 22 is the apparatus of example 21, wherein the at least one magnetic source comprises at least one permanent magnet rotating about an axis.

Example 23 is the apparatus of example 22, wherein the at least one magnetic source comprises a plurality of permanent magnets arranged in a Halbach array.

Example 24 is the apparatus of examples 22 or 23, wherein the at least one magnetic source further comprises a radiant heat reflector and a conductive heat inhibitor surrounding the at least one permanent magnet.

Example 25 is the apparatus of examples 21-24, further comprising a height-adjustment mechanism coupled to the at least one magnetic source to adjust a distance between the at least one magnetic source and the surface of the molten metal.

Example 26 is the apparatus of examples 21-25, further comprising one or more additional magnetic sources for generating one or more additional alternating magnetic fields sufficient to generate one or more additional eddy currents in the surface of the molten metal sufficient to inhibit rollover of metal oxides.

Example 27 is a method comprising introducing molten metal into a receptacle; generating an alternating magnetic field proximate an upper surface of the molten metal; and directing metal oxide on the upper surface of the molten metal by generating the alternating magnetic field.

Example 28 is the method of example 27, wherein generating the alternating magnetic field comprises rotating one or more permanent magnets about an axis.

Example 29 is the method of examples 27 or 28, wherein introducing the molten metal into the receptacle comprises filling a mold and wherein directing the metal oxide comprises inhibiting rollover of metal oxides by directing the metal oxide to migrate towards a center of the mold.

Example 30 is the method of example 29, wherein filling the mold comprises at least an initial phase and a steady-state phase; wherein inhibiting rollover occurs during the steady-state phase; and wherein directing the metal oxide further comprises encouraging rollover of metal oxides by directing the metal oxide to migrate towards edges of the mold during the initial phase.

Example 31 is the method of examples 27-30, further comprising generating a second alternating magnetic field proximate a meniscus of the upper surface of the molten metal; and adjusting a height of the meniscus based on generating the second alternating magnetic field.

Example 32 is the method of example 31, wherein introducing the molten metal into the receptacle comprises filling a mold; wherein filling the mold comprises at least an initial phase and a steady-state phase; and wherein adjusting the height of the meniscus comprises raising the height of the meniscus during the steady-state phase.

Example 33 is the method of example 32, wherein adjusting the height of the meniscus further comprises lowering the height of the meniscus during the initial phase.

Example 34 is the method of examples 27-33, further comprising adjusting a height of the alternating magnetic field in response to vertical movement of the upper surface of the molten metal.

Example 35 is a system comprising a non-contacting magnetic source positionable adjacent an upper surface of molten metal for generating an alternating magnetic field suitable to control metal oxide migration along the upper surface, and a controller coupled to the non-contacting magnetic source for controlling the alternating magnetic field.

Example 36 is the system of example 35, wherein the non-contacting magnetic source comprises one or more permanent magnets rotatably mounted about one or more axes, and wherein the controller is operable to control rotation of the one or more permanent magnets about the one or more axes.

Example 37 is the system of example 35 or 36, wherein the non-contacting magnetic source is positionable adjacent a meniscus of the upper surface to deform the meniscus.

Example 38 is the system of examples 35 or 36, wherein the non-contacting magnetic source is positionable above the upper surface of the molten metal and between a wall of a mold and a molten metal dispenser.

Example 39 is the system of example 38, wherein the non-contacting magnetic source is height-adjustable to selectively space the non-contacting magnetic source at a desired distance from the upper surface of the molten metal.

Example 40 is the system of examples 38 or 39, wherein the alternating magnetic field is oriented to control migration of the metal oxide along the upper surface in a direction normal to the wall of the mold.

Example 41 is an aluminum product having a crystalline structure with a maximum standard deviation of dendrite arm spacing at or below 16, the aluminum product obtained by introducing molten metal into a mold cavity and inducing molten flow in the molten metal by generating a changing magnetic field proximate an upper surface of the molten metal.

Example 42 is the aluminum product of example 41, wherein the maximum standard deviation of dendrite arm spacing is at or below 10.

Example 43 is the aluminum product of example 41, wherein the maximum standard deviation of dendrite arm spacing is at or below 7.5.

Example 44 is the aluminum product of examples 41-43, wherein the average dendrite arm spacing is at or below 50 μm.

Example 45 is the aluminum product of examples 41-43, wherein the average dendrite arm spacing is at or below 30 μm.

Example 46 is the aluminum product of examples 41-45, wherein inducing molten flow in the molten metal further includes inducing sympathetic flow in the molten metal.

Example 47 is an aluminum product having a crystalline structure with a maximum standard deviation of grain size at or below 200, the aluminum product obtained by introducing molten metal into a mold cavity and inducing molten flow in the molten metal by generating a changing magnetic field proximate an upper surface of the molten metal.

Example 48 is the aluminum product of example 47, wherein the maximum standard deviation of grain size is at or below 80.

Example 49 is the aluminum product of example 47, wherein the maximum standard deviation of grain size is at or below 45.

Example 50 is the aluminum product of examples 47-49, wherein the average grain size is at or below 700 μm.

Example 51 is the aluminum product of examples 47-49, wherein the average grain size is at or below 400 μm.

Example 52 is the aluminum product of examples 47-51, wherein inducing molten flow in the molten metal further includes inducing sympathetic flow in the molten metal.

Example 53 is the aluminum product of examples 47-52, wherein the maximum standard deviation of dendrite arm spacing is at or below 10.

Example 54 is the aluminum product of examples 47-52, wherein the maximum standard deviation of dendrite arm spacing is at or below 7.5.

Example 55 is the aluminum product of examples 47-52, wherein the average dendrite arm spacing is at or below 50 μm.

Example 56 is the aluminum product of examples 47-52, wherein the average dendrite arm spacing is at or below 30 μm.

What is claimed is:

1. An apparatus comprising:

a mold for accepting molten metal, wherein the mold comprises one or more stationary mold walls for solidifying the molten metal into a solidifying ingot;

a bottom block lowerable to support the solidifying ingot, wherein a molten sump of the solidifying ingot extends from a surface of the molten metal to a point below the one or more mold walls;

a submersible feed tube couplable to a metal source and positioned to supply the molten metal to the molten sump; and at least one non-contact flow inducer positioned above the surface of the molten metal for generating a changing magnetic field proximate the surface of the molten metal for inducing molten flow in the molten metal, wherein the induced molten flow is configured to excite a velocity of the molten metal adjacent a transitional region between the molten metal and the solidifying ingot.

2. The apparatus of claim 1, wherein the at least one non-contact flow inducer includes a first non-contact flow inducer positioned opposite a mold centerline from and parallel with a second non-contact flow inducer.

3. The apparatus of claim 1, wherein the at least one non-contact flow inducer is positioned proximate a corner of the mold for inducing the molten flow through the corner of the mold.

4. The apparatus of claim 3, wherein the at least one non-contact flow inducer includes a plurality of permanent magnets positioned on a rotating plate that rotates about a rotational axis.

5. The apparatus of claim 1, wherein the at least one non-contact flow inducer comprises at least one permanent magnet rotating about an axis.

6. The apparatus of claim 5, wherein the axis is positioned parallel to a mold centerline.

7. The apparatus of claim 5, wherein the axis is positioned along a radius extending from a center of the mold.

8. The apparatus of claim 1, wherein the at least one non-contact flow inducer is positioned to induce the molten flow at the surface of the molten metal towards the one or more mold walls.

9. The apparatus of claim 1, wherein at least one of the one or more stationary mold walls contacts the molten metal while the molten metal solidifies into the solidifying ingot.

10. A method comprising:

introducing molten metal into a mold cavity comprising one or more stationary mold walls for solidifying the molten metal into a solidifying ingot, wherein introducing the molten metal comprises passing the molten metal from a metal source to a molten sump of the solidifying ingot using a submersible feed tube;

lowering a bottom block of a mold cavity as the molten metal begins to solidify within the mold cavity, wherein the molten sump extends from an upper surface of the molten metal to a point below the one or more mold walls;

generating a changing magnetic field proximate the upper surface of the molten metal; and inducing molten flow in the molten metal by generating the changing magnetic field using at least one non-contact flow inducer positioned above the surface of the molten metal, wherein the induced metal flow is configured to excite a velocity of the molten metal adjacent a transitional region between the molten metal and the solidifying ingot.

11. The method of claim 10, further comprising:

inducing sympathetic flow in the molten metal by inducing the molten flow.

12. The method of claim 11, wherein inducing the sympathetic flow comprises inducing a sympathetic flow to mix the molten metal and reduce a thickness of the transitional region to approximately less than 3 millimeters.

13. The method of claim 11, wherein inducing the sympathetic flow comprises inducing a sympathetic flow to mix the molten metal and reduce a thickness of the transitional region to approximately less than 1 millimeter.

14. The method of claim 10, wherein inducing the molten flow comprises:

inducing a first molten flow towards a mold centerline of the mold cavity; and inducing a second molten flow towards the mold centerline and in a direction opposite the first molten flow.

15. The method of claim 10, wherein inducing the molten flow comprises inducing the molten flow in a generally circular direction.

16. The method of claim 10, wherein inducing the molten flow comprises inducing the molten flow through a corner of the mold cavity.

17. A system comprising:

a mold for accepting molten metal, wherein the mold comprises one or more stationary mold walls for solidifying the molten metal into a solidifying ingot;

a bottom block lowerable to support the solidifying ingot, wherein a molten sump of the solidifying ingot extends from a surface of the molten metal to a point below the one or more mold walls;

a submersible feed tube couplable to a metal source and positioned to supply the molten metal to the molten sump;

a non-contacting flow inducer positioned directly above the surface of the molten metal; and a magnetic source included in the non-contacting flow inducer for generating a changing magnetic field for inducing molten flow under the surface of the molten metal and increasing mixing of the molten metal.

18. The system of claim 17, wherein the magnetic source includes at least one permanent magnet rotating about a rotational axis at a speed between approximately 10 revolutions per minute and approximately 500 revolutions per minute.

19. The system of claim 17, wherein the non-contacting flow inducer is oriented to induce the molten flow in a direction parallel at least one of the one or more mold walls.

20. The system of claim 17, wherein the non-contacting flow inducer is oriented to induce the molten flow in a direction perpendicular a radius extending from a center of the mold.

21. The system of claim 17, wherein the non-contacting flow inducer is positioned to induce molten flow at the surface of the molten metal towards at least one of the one or more mold walls.

22. The system of claim 17, wherein at least one of the one or more stationary mold walls contacts the molten metal while the molten metal solidifies into the solidifying ingot.

23. An apparatus comprising:

a mold for accepting molten metal, wherein the mold comprises one or more stationary mold walls for solidifying the molten metal into a solidifying ingot;

a bottom block lowerable to support the solidifying ingot, wherein a molten sump of the solidifying ingot extends from a surface of the molten metal to a point below the one or more mold walls;

a submersible feed tube couplable to a metal source and positioned to supply the molten metal to the molten sump; and at least one magnetic source positioned above the mold for generating an alternating magnetic field proximate the surface of the molten metal for directing movement of metal oxides on the surface of the molten metal and increasing mixing and velocity of the molten metal adjacent a transitional region between the molten metal and the solidifying ingot.

24. The apparatus of claim 23, wherein the at least one magnetic source comprises at least one permanent magnet rotating about an axis.

25. The apparatus of claim 24, wherein the at least one magnetic source comprises a plurality of permanent magnets arranged in a Halbach array.

26. The apparatus of claim 24, wherein the at least one magnetic source further comprises a radiant heat reflector and a conductive heat inhibitor surrounding the at least one permanent magnet.

27. The apparatus of claim 23, further comprising a height-adjustment mechanism coupled to the at least one magnetic source to adjust a distance between the at least one magnetic source and the surface of the molten metal.

28. The apparatus of claim 23, further comprising one or more additional magnetic sources for generating one or more additional alternating magnetic fields for generating one or more additional eddy currents in the surface of the molten metal to inhibit rollover of metal oxides.

29. The apparatus of claim 23, wherein the at least one magnetic source is positioned to direct movement of metal oxides on the surface of the molten metal towards at least one of the one or more mold walls.

30. The apparatus of claim 23, wherein at least one of the one or more stationary mold walls contacts the molten metal while the molten metal solidifies into the solidifying ingot.

* * * * *